US008918034B2

(12) United States Patent
Matsumoto et al.

(10) Patent No.: US 8,918,034 B2
(45) Date of Patent: Dec. 23, 2014

(54) POWDER ACCOMMODATION CONTAINER, IMAGE FORMING APPARATUS AND MANUFACTURING METHOD OF THE IMAGE FORMING APPARATUS

(71) Applicant: Fuji Xerox Co., Ltd., Tokyo (JP)

(72) Inventors: Takuji Matsumoto, Kanagawa (JP); Iori Togu, Kanagawa (JP); Naofumi Murayama, Kanagawa (JP); Shigemasa Nakaya, Kanagawa (JP); Takuya Iwamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/136,809

(22) Filed: Dec. 20, 2013

(65) Prior Publication Data

US 2014/0105652 A1 Apr. 17, 2014

Related U.S. Application Data

(63) Continuation of application No. 13/724,986, filed on Dec. 21, 2012.

(30) Foreign Application Priority Data

Mar. 27, 2012 (JP) ..... 2012-070969
Mar. 27, 2012 (JP) ..... 2012-070971
Mar. 27, 2012 (JP) ..... 2012-070973

(51) Int. Cl.
*G03G 15/08* (2006.01)
*G03G 21/18* (2006.01)

(52) U.S. Cl.
CPC ..... *G03G 15/0875* (2013.01); *G03G 15/0879* (2013.01); *G03G 15/0887* (2013.01); *G03G 15/0832* (2013.01); *G03G 21/1857* (2013.01); *G03G 15/0877* (2013.01); *G03G 15/0891* (2013.01); *G03G 15/0889* (2013.01)
USPC ..... 399/263

(58) Field of Classification Search
CPC ..... G03G 21/1857; G03G 15/0875; G03G 15/0832
USPC ..... 399/263
See application file for complete search history.

(56) References Cited

U.S. PATENT DOCUMENTS 5,434,654 A 7/1995 Nagai
5,909,610 A 6/1999 Yoshiki et al.

(Continued)

FOREIGN PATENT DOCUMENTS

CN 1811615 A 8/2006
CN 1770029 A 5/2010

(Continued)

OTHER PUBLICATIONS

Australian Office Action dated Aug. 5, 2013 from Australian Patent Application No. 2013200196.

(Continued)

*Primary Examiner* — David Gray
*Assistant Examiner* — Tyler Hardman
(74) *Attorney, Agent, or Firm* — Oliff PLC

(57) ABSTRACT

A powder accommodation container includes an accommodation container body, a regulation member, and a transport member. The accommodation container body has a hole portion to outside and accommodates powder. The regulation member is provided in the hole portion to regulate a passage of the powder accommodated in the accommodation container body. The transport member is arranged in an inside of the accommodation container body to rotate about a rotating shaft and to transport the powder in the inside of the accommodation container body. The transport member has one end side in a short direction that is arranged on the rotating shaft and the other end side that is a free end, the free end includes a flexible member that is in contact with the accommodation container body to be flexed. The flexible member is locatable to face the hole portion.

10 Claims, 17 Drawing Sheets

(56) References Cited

U.S. PATENT DOCUMENTS

| | | | | |
|---|---|---|---|---|
| 7,054,582 | B2 | 5/2006 | Huang et al. | |
| 8,045,901 | B2 * | 10/2011 | Yamada et al. | 399/260 |
| 8,644,739 | B2 | 2/2014 | Ichikawa | |
| 2003/0138273 | A1 * | 7/2003 | Ichikawa et al. | 399/262 |
| 2006/0165441 | A1 | 7/2006 | Deguchi | |
| 2007/0280739 | A1 | 12/2007 | Tanaka | |
| 2008/0279595 | A1 | 11/2008 | Uezono | |
| 2010/0266310 | A1 | 10/2010 | Saiki et al. | |
| 2010/0322666 | A1 | 12/2010 | Inomata et al. | |
| 2012/0033999 | A1 | 2/2012 | Ichikawa | |
| 2013/0322929 | A1 | 12/2013 | Kobayashi | |

FOREIGN PATENT DOCUMENTS

| | | | |
|---|---|---|---|
| CN | 101866129 | A | 10/2010 |
| CN | 101930202 | A | 12/2010 |
| JP | A-H04-060669 | | 2/1992 |
| JP | A-06-324568 | | 11/1994 |
| JP | A-09-043943 | | 2/1997 |
| JP | A-H10-069157 | | 3/1998 |
| JP | A-11-223993 | | 8/1999 |
| JP | A-11-282243 | | 10/1999 |
| JP | A-2002-006610 | | 1/2002 |
| JP | A-2003-156927 | | 5/2003 |
| JP | A-2006-064794 | | 3/2006 |
| JP | A-2006-276810 | | 10/2006 |
| JP | A-2007-199527 | | 8/2007 |
| JP | A-2007-322863 | | 12/2007 |
| JP | A-2008-112076 | | 5/2008 |
| JP | A-2008-276076 | | 11/2008 |
| JP | A-2008-281806 | | 11/2008 |
| JP | A-2009-098547 | | 5/2009 |
| JP | 2009222807 | A * | 10/2009 |
| JP | A-2009-222807 | | 10/2009 |
| JP | A-2010-096991 | | 4/2010 |
| JP | A-2010-250119 | | 11/2010 |
| JP | A-2011-7828 | | 1/2011 |
| JP | A-2011-186198 | | 9/2011 |

OTHER PUBLICATIONS

Notice of Reasons for Refusal dated Apr. 20, 2012 from Japanese Patent Application No. 2012-070973 (with English-language translation).

Mar. 25, 2014 Office Action cited in Korean Patent Application No. 10-2013-0163478 (with translation).

Mar. 25, 2014 Office Action cited in Korean Patent Application No. 10-2013-0163464 (with translation).

Apr. 22, 2014 Office Action cited in U.S. Appl. No. 13/724,986.

Apr. 18, 2014 Office Action cited in U.S. Appl. No. 14/136,114.

Jun. 30, 2014 Office Action issued in Chinese Patent Application No. 201310741139.7 (with translation).

Jul. 3, 2014 Office Action issued in Chinese Patent Application No. 201310741065.7 (with translation).

Oct. 1, 2014 Office Action issued in U.S. Appl. No. 13/724,986.

* cited by examiner

POWDER ACCOMMODATION CONTAINER, IMAGE FORMING APPARATUS AND MANUFACTURING METHOD OF THE IMAGE FORMING APPARATUS

CROSS-REFERENCE TO RELATED APPLICATIONS

This application is Continuation of U.S. patent application Ser. No. 13/724,986 filed Dec. 22, 2012 which claims priority under 35 USC 119 from Japanese Patent Application Nos. 2012-070971 filed on Mar. 27, 2012, 2012-070973 filed on Mar. 27, 2012, and 2012-070969, filed on Mar. 27, 2012.

BACKGROUND

The present invention relates to a powder accommodation container and an image forming apparatus.

SUMMARY OF THE INVENTION (1) According to an aspect of the invention, a powder accommodation container includes:

an accommodation container body that has a hole portion to outside and accommodates powder;

a regulation member that is provided in the hole portion to regulate a passage of the powder accommodated in the accommodation container body; and a transport member that is arranged in an inside of the accommodation container body to rotate about a rotating shaft container body, wherein the transport member has one end side in a short direction that is arranged on the rotating shaft and the other end side that is a free end, the free end includes a flexible member that is in contact with the accommodation container body to be flexed, and the flexible member is locatable to face the hole portion.

(2) In the powder accommodation container of (1), a position of the flexible member is ascertainable from the outside of the powder accommodation container.

(3) In the powder accommodation container of (1) or (2), the regulation member is provided on an inner surface side of the accommodation container body at the hole portion.

(4) The powder accommodation container of any one of (1) to (3) further includes a projection portion that projects from an inner surface of the accommodation container body, that is in contact with the flexible member, and that is formed on at least an upstream side in a passage direction of the flexible member at the hole portion on the inner surface of the accommodation container body.

(5) The powder accommodation container of any one of (1) to (4) further includes a discharge port that discharge the powder to an outside at one end side of the transport member in the accommodation container body, wherein the hole portion is formed at the other end side of the transport member in the accommodation container body.

(6) According to another aspect of the invention, an image forming apparatus includes:

a device main body that has an image forming portion that forms an image on a recording material; and a powder accommodation container that is mounted on the device main body and accommodates the powder that is used in the image forming portion, wherein the powder accommodation container is the powder accommodation container described in any one of (1) to (5).

(7) According to another aspect of the invention, a method for manufacturing a powder accommodation container which has a hole portion to outside, a regulation member provided in the hole portion to regulate a passage of powder, and a transport member transporting the powder using a flexible member, the method includes:

moving the transport member so that the flexible member faces the hole portion; and filling the powder in the powder accommodation container in a state where the flexible member faces the hole portion.

(8) According to another aspect of the invention, a method for manufacturing a powder accommodation container which has an accommodation container body having a hole portion to outside and accommodating powder, a regulation member provided in the hole portion to regulate a passage of the powder accommodated in the accommodation container body, and a transport member transporting the powder using a flexible member, the method includes:

filling the powder in the powder accommodation container; and making the flexible member face the hole portion.

With the configuration of (1), it is restrained that the powder is attached to the regulation member that regulates the passage of the powder in comparison to the case where the flexible member does not face the hole portion.

With the configuration of (2), it can be confirmed from the outside of the powder accommodation container that the transport member does not face the hole portion.

With the configuration of (3), it becomes hard to happen that the hole portion is clogged by the powder in comparison to the case where the regulation member is provided on the outer surface side of the accommodation container body.

With the configuration of (4), the imposition load of the flexible member for the regulation member can be reduced in comparison to the case where the projection portion is not provided.

With the configuration of (5), the discharge of the powder from the discharge port can be performed more smoothly in comparison to the case where the hole portion is provided on the same side as the side where the discharge port is provided.

With the configuration of (6), it is restrained that the powder is attached to the regulation member that regulates the passage of the powder in comparison to the case where the flexible member does not face the hole portion.

With the configuration of (7) or (8), it is restrained that the powder is attached to the regulation member that regulates the passage of the powder in comparison to the case where the flexible member does not face the hole portion.

(1a) According to another aspect of the invention, a powder accommodation container includes an accommodation container body that accommodates powder, a transport member that is arranged in an inside of the accommodation container body and rotates about a rotating shaft to transport powder in the inside of the accommodation container body, and a discharge port that discharges the powder accommodated in the accommodation container body to an outside. The accommodation container body includes a first region formed so that width dimensions of the first region in a direction that crosses the rotating shaft are first dimensions, and a second region arranged to be closer to the discharge port than the first region in an axis direction of the rotating shaft and formed so that width dimensions of the second region in the direction that crosses the rotating shaft are second dimensions which are smaller than the first dimensions. One end side of the transport member in a short direction of the transport member is arranged on the rotating shaft. The other end side of the transport member in the short direction of the transport member is a free end having a flexible member which is bent in contact with the accommodation container body. The flexible member has a plurality of slant pieces that are slanted for the rotating shaft from the free end. The slanted angle of the slant piece, with respect to the free end, which is closer to the discharge port than a connection portion between the first region and the second region is larger than a slanted angle of the slant piece, with respect to the free end, which is farther from the discharge port than the connection portion.

(2a) In the powder accommodation container of (1a), the rotating shaft has a contact portion provided at a position farther from the discharge port than the connection portion to be in contact with the flexible member in a bent state of the flexible member.

(3a) In the powder accommodation container of (2a), the discharge port is provided in the second region.

(4a) In the powder accommodation container of (2a) or (3a), wherein the flexible member and the contact portion extend to the same direction in a radial direction of the rotating shaft.

(5a) In the powder accommodation container of (3a), the flexible member and the contact portion extend to the same direction in a radial direction of the rotating shaft.

(6a) In the powder accommodation container of any one of (2a) to (4a), an attachment surface to which the flexible member is attached is formed on the rotating shaft, and the contact portion projects from the rotating shaft in parallel to the attachment surface.

(7a) In the powder accommodation container of (3a), an attachment surface to which the flexible member is attached is formed on the rotating shaft, and the contact portion projects from the rotating shaft in parallel to the attachment surface.

(8a) In the powder accommodation container of any one of (1a) to (5a), in the accommodation container body, a third region having smaller width dimensions than the second region is provided on an opposite side of the first region for the second region in an axial direction of the rotating shaft.

(9a) In the powder accommodation container of any one of (1a) to (8a), a cross section of a surface that crosses the axial direction of the rotating shaft on the side of the second region is smaller than that on the side of the first region.

(10a) According to another aspect of the invention, an image forming apparatus includes an apparatus body having an image forming portion forming an image on a recording material and a powder accommodation container mounted in the apparatus body to accommodate powder that is used in the image forming portion. The powder accommodation container is the powder accommodation container described in any one of (1a) to (8a).

With the configuration of (1a), the amount of powder discharged from the powder accommodation container can be stabilized in comparison to the case that does not have the present configuration.

With the configuration of (2a), the flexible member can be prevented from being excessively bent.

With the configuration of (3a), the amount of powder discharged from the powder accommodation container can be stabilized in comparison to the case that does not have the present configuration.

With the configurations of (4a) and (5a), the flexible member can be prevented from being excessively bent.

With the configurations of (6a) and (7a), the flexible member can be prevented from being excessively bent.

With the configuration of (8a), the amount of powder discharged from the powder accommodation container can be stabilized in comparison to the case that does not have the third region.

With the configuration of (9a), the amount of powder discharged from the powder accommodation container can be stabilized in comparison to the case that does not have the present configuration.

With the configuration of (10a), deterioration of the image is reduced.

(1b) According to another aspect of the invention, a powder accommodation container mountable on a device main body having a rotary driving member, the powder accommodation container includes:

an accommodation container body that accommodates powder;

a transport member that is arranged in an inside of the accommodation container body, rotates about a rotating shaft and transports the powder in the inside of the accommodation container body; and a discharge port that discharges the powder accommodated in the accommodation container body to the device main body, wherein the discharge port, a rotating member receiving a rotation transferred from the driving member and rotating the transport member, and a concave portion into which a first projection formed on the same axis of the driving member enters are formed on one end side in a longer direction of the accommodation container body, an outer surface of the rotating member contacts with an outer surface of the driving member, and the concave portion is formed on the accommodation container body.

(2b) In the powder accommodation container of (1b), the first projection is a support axis which rotatably supports the driving member.

(3b) In the powder accommodation container of (1b), the device main body includes a second projection that is provided below the first projection and parallel to the first projection. The powder accommodation container has a portion enters into a gap between the first projection and the second projection at the one end side.

(4b) In the powder accommodation container of any one of (1b) to (3b), the rotating member is attached to one of a plurality of surfaces that the powder accommodation container has. The rotating member is arranged in a state where the rotating member is accommodated in an inside of an outer periphery of the one surface.

(5b) In the powder accommodation container of any one of (1b) to (4b), the rotating member is attached to the one of the plurality of surfaces that the powder accommodation container has. A wall portion is extended in a shaft direction of the rotating member around the rotating member is formed on the one surface. The wall portion is formed higher in the shaft direction than the rotating member.

(6b) According to another aspect of the invention, an image forming apparatus includes:

a powder accommodation container that includes:

an accommodation container body accommodating powder;

a transport member arranged in an inside of the accommodation container body, rotating about a rotating shaft and transporting the powder in the inside of the accommodation container body; and a discharge port discharging the powder accommodated in the accommodation container body to a device main body; and the device main body on which the powder accommodation container is mounted and which includes a driving member driving the transport member.

The discharge port, a rotating member receiving a rotation transferred from the driving member and rotating the transport member, and a concave portion into which a first projection formed on the same axis of the driving member enters are formed on one end side in a longer direction of the accommodation container body.

An outer surface of the rotating member contacts with an outer surface of the driving member.

The concave portion is formed on the accommodation container body.

(7b) In the powder accommodation container of (1b), the first projection is a support axis which rotatably supports the driving member.

(8b) In the image forming apparatus of (6b), the device main body includes a second projection that is provided below the first projection and parallel to the first projection. The powder accommodation container has a portion enters into a gap between the first projection and the second projection at the one end side.

(9b) In the image forming apparatus of any one of (6b) to (8b), the rotating member is attached to one of a plurality of surfaces that the powder accommodation container has, and the rotating member is arranged in a state where the rotating member is accommodated in an inside of an outer periphery of the one surface.

(10b) In the image forming apparatus of any one of (6b) to (9b), the rotating member is attached to the one of the plurality of surfaces that the powder accommodation container has, a wall portion that is extended in a shaft direction of the rotating member around the rotating member is formed on the one surface, and the wall portion is formed highly in the shaft direction than the rotating member.

With the configuration of (1b), the rotation can be transferred to the rotating member more accurately and the powder can be prevented from leaking from the discharge port in comparison to the case that does not have the present configuration.

With the configuration of (2b), the rotation can be transferred to the rotating member much more accurately and the powder can be prevented from leaking from the discharge port in comparison to the case that does not have the present configuration.

With the configuration of (3b), the device main body can be miniaturized in comparison to the case that does not have the present configuration.

With the configuration of (4b), the rotating member can be prevented from being damaged.

With the configuration of (5b), the rotating member can be prevented from being damaged.

With the configuration of (6b), the rotation can be transferred to the rotating member more accurately and the powder can be prevented from leaking from the discharge port in comparison to the case that does not have the present configuration.

With the configuration of (7b), the rotation can be transferred to the rotating member more accurately and the powder can be prevented from leaking from the discharge port in comparison to the case that does not have the second projection.

With the configuration of (8b), the device main body can be miniaturized in comparison to the case that does not have the present configuration.

With the configuration of (9b), the rotating member can be prevented from being damaged.

With the configuration of (10b), the rotating member can be prevented from being damaged.

BRIEF DESCRIPTION OF THE DRAWINGS

Exemplary embodiments of the invention will be described in detail based on the following figures, wherein.

DETAILED DESCRIPTION

Hereinafter, embodiments of the present invention will be described in detail with reference to the accompanying drawings.

Figure 1:
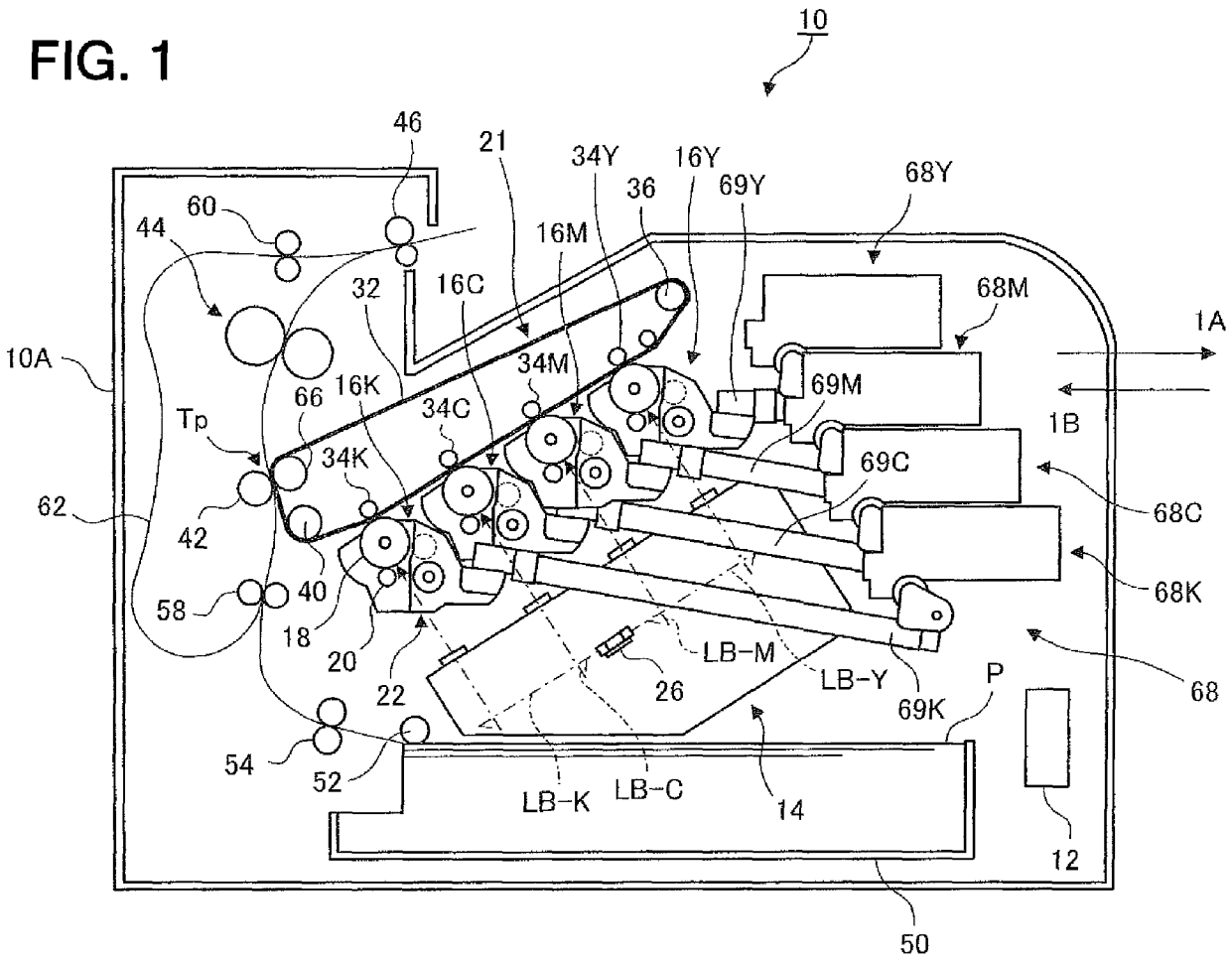
FIG. 1 is a view illustrating the overall configuration of an image forming apparatus according to the exemplary embodiment.

FIG. 1 is a view illustrating the overall configuration of an image forming apparatus 10 according to this embodiment. As shown in the drawing, the image forming apparatus 10 according to this embodiment includes an image processing unit 12 provided inside an apparatus body 10A to perform a predetermined image process with respect to received image data. Further, the image forming apparatus 10 according to this embodiment includes an exposure device 14 provided to receive the image data from the image processing unit 12 and to perform exposure by laser beams LB.

Further, on an upper side of the exposure device 14, four image forming units 16Y, 16M, 16C, and 16K forming toner images of yellow (Y), magenta (M), cyan (C), and black (K). Here, the four image forming units 16Y, 16M, 16C, and 16K, which function as parts of an image forming unit, are arranged to line up in a slant direction with respect to the horizontal direction. Further, the four image forming units 16Y, 16M, 16C, and 16K are detachably provided on the apparatus body 10A.

Each of the image forming units 16Y, 16M, 16C, and 16K includes a cylindrical photosensitive drum 18 rotating at a predetermined speed, a charging member 20 charging a circumferential surface of the photosensitive drum 18, a developing device 22 developing an electrostatic latent image formed on the photosensitive drum 18 through exposure by an exposure device 14 using toner as an example of the powder, and a drum cleaner (not illustrated) contacting the photosensitive drum 18 to remove the toner and the like attached to the photosensitive drum 18. Further, the image forming apparatus 10 according to this embodiment includes a toner supply device 68 supplying the toner to the developing device 22 provided in each of the image forming units 16Y, 16M, 16C, and 16K.

Here, the toner supply device 68 has four toner cartridges 68Y, 68M, 68C, and 68K that accommodate yellow, magenta, cyan, and black toners, respectively. Further, the toner supply device 68 has a first transport pipe 69Y, a second transport pipe 69M, a third transport pipe 69C, and a fourth transport pipe 69K that transport the toners accommodated in the toner cartridges 68Y, 68M, 68C, and 68K to the corresponding developing device 22.

On the other hand, in this embodiment, the four toner cartridges 68Y, 68M, 68C, and 68K which function as developing members can be taken off from the apparatus body 10A by moving them in a direction indicated by an arrow 1A in the drawing. Further, the four toner cartridges 68Y, 68M, 68C, and 68K can be mounted in the apparatus body 10A by moving them in a direction indicated by an arrow 1B. On the other hand, an opening and closing covers (not illustrated) are provided on the apparatus body 10A, and this opening and closing covers are opened when the toner cartridges 68Y, 68M, 68C, and 68K are taken off or mounted.

The exposure device 14 has four semiconductor lasers (not illustrated), and laser beams LB-Y, LB-M, LB-C, and LB-K are emitted from the semiconductor lasers according to image data. On the other hand, the laser beams LB-Y, LB-M, LB-C, and LB-K emitted from the semiconductor lasers are emitted to a polygon mirror 26 through a cylindrical lens, and are deflection scanned by the polygon mirror 26. The laser beams LB-Y, LB-M, LB-C, and LB-K deflection scanned by the polygon mirror 26 are slantingly input from a lower side to exposure points on the photosensitive drum 18 through an image forming lens (not illustrated) and a plurality of mirrors.

Further, according to this embodiment, a transfer unit 21 is provided on an upper side of the image forming units 16Y, 16M, 16C, and 16K. This transfer unit 21 includes an intermediate transfer belt 32 endlessly formed to circulate along a predetermined path, a drive roll 36 arranged in the inside of the intermediate transfer belt 32 to rotate the intermediate transfer belt 32 in a clockwise direction as shown in the drawing, a tension grant roll 40 pushed from the inside of the intermediate transfer belt 32 to the intermediate transfer belt 32 to grant a tension to the intermediate transfer belt 32, and a driven roll 65 arranged on an upper side than the tension grant roll 40 as shown in the drawing to be rotated by a driving force received from the intermediate transfer belt 32. Further, in this embodiment, a belt cleaner (not illustrated) is provided to remove the toner and the like attached to the intermediate transfer belt 32.

Further, the transfer unit 21 includes primary transfer rolls 34Y, 34M, 34C, and 34K arranged to face the photosensitive drums 18, respectively, on the inside of the intermediate transfer belt 32. Here, each of the first transfer rolls 34Y, 34M, 34C, and 34K transfers a toner image on the photosensitive drum 18 provided in each of the image forming units 16Y, 16M, 16C, and 16K to the intermediate transfer belt 32. Through this, on the intermediate transfer belt 32, a toner image in which four toner images of a yellow toner image, a magenta toner image, a cyan toner image, and a black toner image overlap one another is formed.

Further, in this embodiment, a secondary transfer roll 42 is provided in an opposite position of the driven roll 66 while the intermediate transfer belt 32 is interposed between them. The toner image formed on the intermediate transfer belt 32 is transported up to a region where the second transfer roll 42 is provided by the intermediate transfer belt 32. Then, the toner image is transferred onto a sheet being transported by a secondary transfer portion Tp where the secondary transfer roll 42 and the driven roll 66 are in press contact with each other. Further, in this embodiment, on the downstream side in a transport direction of the sheet P than the secondary transfer portion Tp, a fixing device 44 that fixes the toner image transferred to the sheet P onto the sheet P using heat and pressure is provided. Further, on the downstream side of the fusing device 44, a discharge roll 46 discharging the sheet P of which the fixing process has been completed to an upper portion of the apparatus body 10A is provided.

Further, in this embodiment, a sheet accommodation portion 50 accommodating a plurality of sheets P, a delivery roll 52 that is in contact with the uppermost one of the sheets P accommodated in the sheet accommodation portion 50 to deliver the sheet P, and a transport roll 54 separating the sheets P delivered by the delivery roll 52 one by one and transporting the separated sheets P are provided. Further, on the downstream side of the transport roll 54, a transport roll 58 that further transports the sheet P toward the secondary transfer portion Tp is provided. Further, in this embodiment, a transport roll 60 is provided to transport the sheet P having one surface, to which the toner image has been fixed, to a transport path 62 for both-sided printing. Here, the sheet P sent to the transport path 62 for both-sided printing is supplied again to the secondary transfer portion Tp in a state where both sides thereof have been reversed. Through this, images are formed on both sides of the sheet P Here, when the image forming is performed by the image forming apparatus 10 according to this embodiment, for example, image data acquired by a manuscript scanning device (not illustrated) or image data formed by a PC (not illustrated) is input to the image processing unit 12 as 8-bit data of red (R), green (G), and blue (B), respectively. The image processing unit 12 performs predetermined image processing, such as shading correction, position gap correction, brightness/color space conversion, gamma correction, border erase or color edition, and movement edition, with respect to the input data. The image data of which the image processing has been performed is converted into gradation data of four colors of yellow, magenta, cyan, and black to be output to the exposure device 14.

As described above, the exposure device 14 has four semiconductor lasers, and laser beams LB-Y, LB-M, LB-C, and LB-K are emitted from the semiconductor lasers according to gradation data. On the other hand, the laser beams LB-Y, LB-M, LB-C, and LB-K emitted from the semiconductor lasers are emitted to the polygon mirror 26 through the cylindrical lens, and are deflection scanned by the polygon mirror 26. The laser beams LB-Y, LB-M, LB-C, and LB-K deflection scanned by the polygon mirror 26 are input to the photosensitive drum 18.

Through this, the surface of the photosensitive drum 18 is scanning exposed, and an electrostatic latent image is formed thereon. The formed electrostatic latent image is developed as toner images of respective colors of yellow, magenta, cyan, and black by the developing devices 22 provided in the respective image forming units 16Y, 16M, 16C, and 16K. Further, the toner images formed on the photosensitive drums 18 of the image forming units 16Y, 16M, 16C, and 16K are transferred onto the intermediate transfer belt 32 by the primary transfer rolls 34Y, 34M, 34C, and 34K.

On the other hand, in a sheet transport system transporting the sheet P, the delivery roll 52 is rotated, and the sheet P is delivered from the sheet accommodation portion 50. Further, the sheets P separated one by one by the transport roll 54 are transported up to the transport roll 58 and then are stopped. Thereafter, the transport roll 58 is rotated to match the movement timing of the intermediate transfer belt 32 on which the toner image is formed, and the sheet P is transported to the secondary transport portion Tp that is formed by the driven roll 66 and the secondary transfer roll 42.

Further, in the secondary transfer portion Tp, the toner images formed on the intermediate transfer belt 32 are sequentially transferred onto the sheet P by the contact pressure and an electric field formed by the secondary transfer portion Tp. Thereafter, the sheet P onto which the toner images have been transferred is fixed by the fixing device 44, and then is discharged to the upper portion of the apparatus body 10A by the discharge roll 46. On the other hand, in the case of forming images on both sides of the sheet P, the sheet P is transported again to the secondary transfer portion Tp through sending of the sheet P to the transport path 62 for both-sided printing, and an image is formed on the other side surface of the sheet P.

Figure 2:
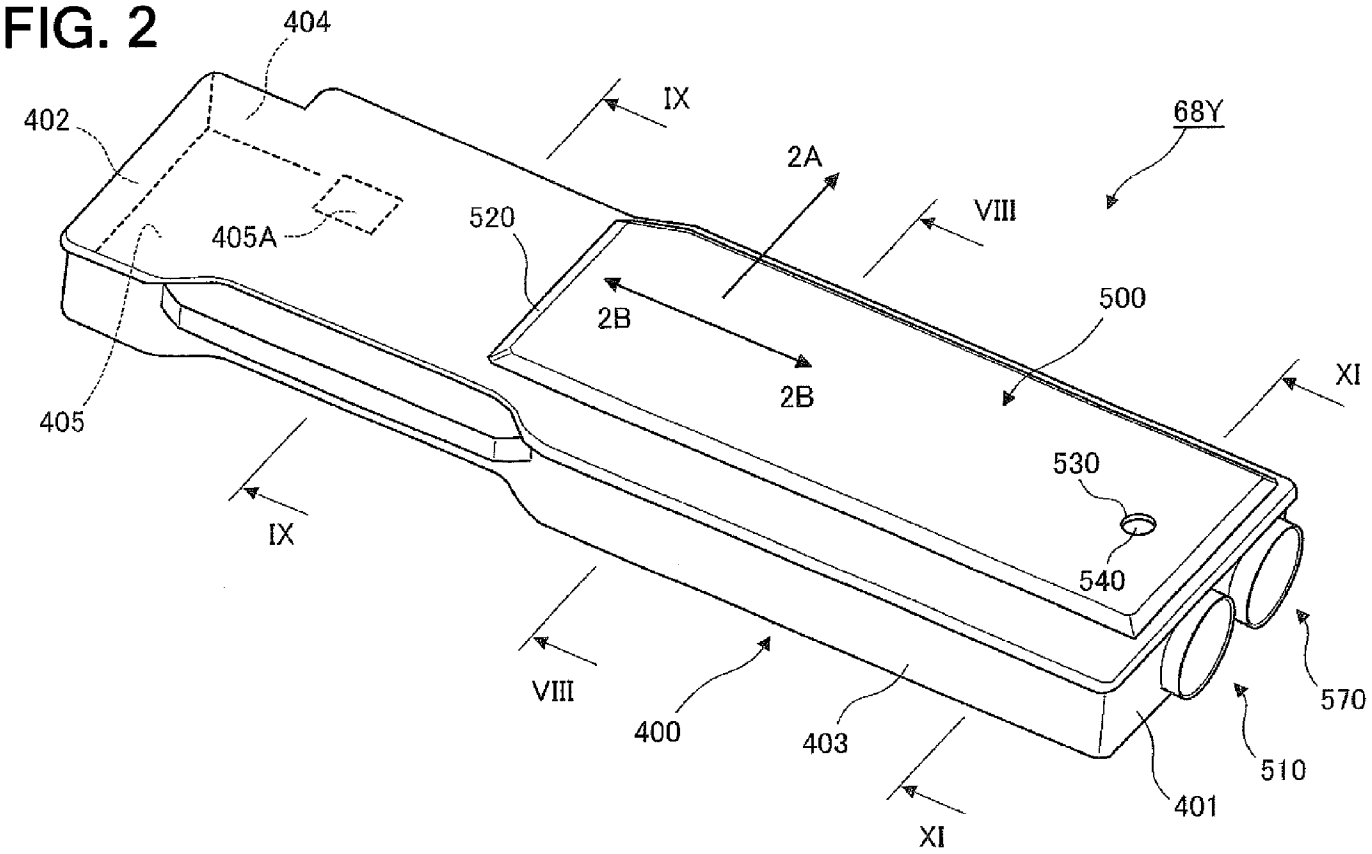
FIG. 2 is a perspective view of a toner cartridge accommodating yellow toner as seen from an upper side.

Here, the toner cartridges 68Y, 68M, 68C, and 68K provided in the toner supply device 68 will be described in detail. FIG. 2 is a perspective view of a toner cartridge 68Y accommodating yellow toner as seen from an upper side. On the other hand, since the toner cartridges 68M, 68C, and 68K are configured in the same manner as the toner cartridge 68Y, the description of the toner cartridges 68M, 68C, and 68K will be omitted.

As shown in the drawing, the toner cartridge 68Y as an example of a powder accommodation container is formed in a rectangular parallelepiped shape. Further, when the toner cartridge 68Y is mounted in the apparatus body 10A, the toner cartridge 68Y is pressed in the direction indicated by an arrow 2A as shown in the drawing to be mounted in the apparatus body 10A. Further, the toner cartridge 68Y according to this embodiment is extended in a direction (direction indicated by an arrow 2B in the drawing) that is orthogonal to the fixing direction (direction indicated by an arrow 2A in the drawing) when the toner cartridge 68Y is mounted in the apparatus body 10A and is in an elongated shape.

Further, in the toner cartridge 68Y, an accommodation container body (cartridge body) composed of a toner accommodation portion 400 and a cover member 500 is provided. Here, the toner accommodation portion 400 is formed in a box shape and has a rectangular opening formed on an upper portion thereof. Further, the cover member 500 is attached to the upper portion of the toner accommodation portion 400, is formed in a rectangular shape, and blocks up the opening formed on the upper portion of the toner accommodation portion 400. On the other hand, the accommodation of the toner in the inside of the toner cartridge 68Y is performed by supplying the toner into the inside of the toner cartridge 68Y through an opening 510 provided on a side surface of the toner cartridge 68Y.

In other words, after the cover member 500 is mounted on the toner accommodation portion 400, the toner is supplied through the opening 510, and the toner is accommodated in the toner cartridge 68Y. Here, after the supply of the toner to the inside of the toner cartridge 68Y is completed, the opening 510 is blocked up. On the other hand, one more opening 570 are provided on the side of the opening 510. When the toner is supplied into the toner cartridge 68Y through the opening 510, air inside the toner cartridge 68Y is discharged through the opening 570. On the other hand, the opening 570 is also blocked up after the supply of the toner into the toner cartridge 68Y is completed.

The toner accommodation portion 400 includes a first side wall 401 arranged along the mounting direction (direction indicated by an arrow 2A) when the toner cartridge 68Y is mounted in the apparatus body 10A, a second side wall 402 arranged in an opposite position of the first side wall 401, a third side wall 403 arranged to be orthogonal to the first side wall 401, and a fourth side wall 404 arranged in an opposite position of the third side wall 403. Further, the toner accommodation unit 400 includes a bottom plate 405 which is formed in a rectangular shape and is connected to lower end portions of the first to fourth side walls 401 to 404. Here, on the bottom plate 405, a toner discharge port 405A that is formed in a rectangular shape and is used to discharge the toner is formed. On the other hand, the first to fourth side walls 401 to 404 and the bottom plate 405 are integrally formed to constitute the toner accommodation portion 400.

On the other hand, the cover member 500 is also formed in a rectangular shape as described above. Further, the cover member 500 has a through-hole 530 formed thereon to function as a hole portion for introducing external air of the toner cartridge 68Y into the inside. Here, if the toner inside the toner cartridge 68Y is discharged, the internal pressure of the toner cartridge 68Y decreases, and thus it becomes difficult to discharge the toner. In this embodiment, air is supplied into the toner cartridge 68Y through a through-hole 530 to facilitate the discharge of the toner.

Further, in this embodiment, in order to prevent the toner from leaking from the through-hole 530, a filter 540 which functions as a regulator member that passes air but regulates the passing of the toner is provided in the inside than the through-hole 530. Here, the filter 540 is formed by nonwoven fabric, textile, or knitting. On the other hand, the material of the filter 540 is not specially limited, and natural fiber or chemical fiber may be used as the material of the filter 540.

Figure 3:
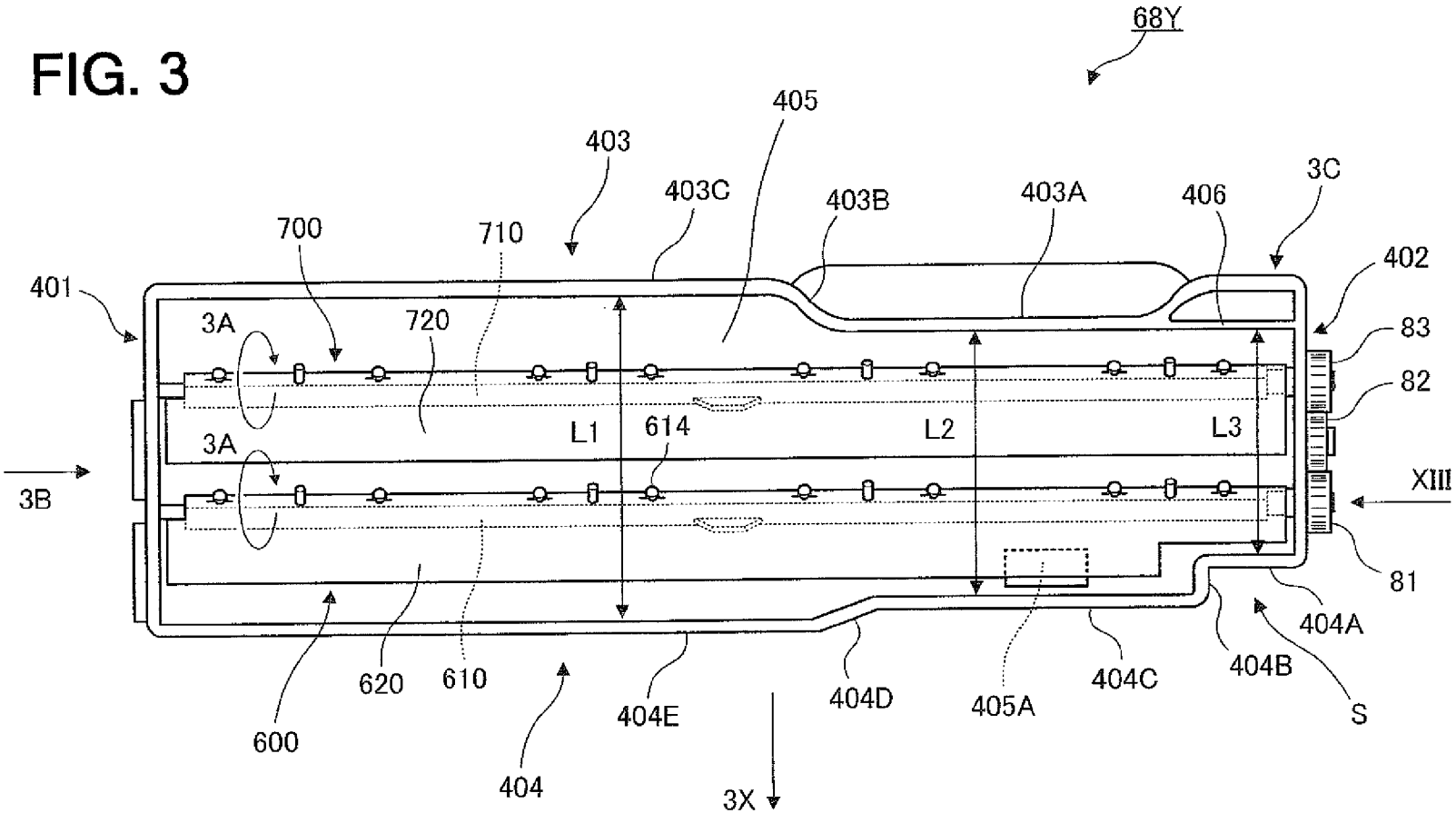
FIG. 3 is a view illustrating a toner cartridge from which a cover member has been taken off.

FIG. 3 is a view illustrating a toner cartridge 68Y from which a cover member 500 has been taken off. FIG. 3 is a view of a toner accommodation portion 400 as seen from an upper side. On the other hand, in FIG. 3, the mounting direction when the toner cartridge 68Y is mounted in the apparatus body 10A is indicated by an arrow 3X.

As described above, the toner accommodation portion 400 is formed in a box shape and has first to fourth side walls 401 to 404 provided on side wall regions. Further, the toner accommodation portion 400 includes a bottom plate 405 on the lower side than the first to fourth side walls 401 to 404. Here, on the bottom plate 405, as described above, the toner discharge port 405A that is formed in a rectangular shape and is used to discharge the toner is formed. On the other hand, the toner discharge port 405A is provided on the side of the second side wall 402 than the center portion in the longer direction of the toner accommodation portion 400. Further, the toner discharge port 405A is provided in a region where the bottom plate 405 and the fourth side wall 404 cross each other.

Although the description has been omitted as described above, in the inside of the toner accommodation portion 400, a first transport member 600 is provided which is arranged along the longer direction of the toner accommodation portion 400 and is provided on the side of the fourth side wall 404 to transport the toner in the toner accommodation portion 400 toward the toner discharge port 405A while stirring the toner. Further, in the inside of the toner accommodation portion 400, a second transport member 700 is provided which is arranged along the longer direction of the toner accommodation portion 400 and is provided on the side of the third side wall 403 to transport the toner in the toner accommodation portion 400 toward the first transport member 600.

Further in this embodiment, on the outer surface of the second side wall 402, a disk-shaped first gear 81 is provided which is tooth-engaged with a transmission gear 910 (to be described later) provided on the side of the apparatus body 10A, and receives a driving force from the transmission gear 910 to be rotated. Further, on the outer surface of the second side wall 402, a disk-shaped second gear 82 is provided which is tooth-engaged with the first gear 81 and receives a driving force from the first gear 81 to be rotated.

Further, on the outer surface of the second side wall 402, a third gear 83 is provided which is disk-shaped, is tooth-engaged with the second gear 82, and receives a driving force from the transmission gear 910 to be rotated. Here, if the first gear 81 receives the driving force and is rotated, the second gear 82 is rotated in an opposite direction to the rotating direction of the first gear 81. Further, if the first gear 81 receives the driving force and is rotated, the third gear 83 is rotated in the same direction as the rotating direction of the first gear 81.

Here, the first transport member 600 includes a rotating shaft 610 arranged along the longer direction of the toner accommodation portion 400 to be rotated, and a seat member 620 which is formed of a resin material such as PET, is in a thin plate shape, and is attached to the rotating shaft 610. Here, the seat member 620 moves the toner accommodated in the toner accommodation portion 400 along the rotating shaft 610 and toward the toner discharge port 405A. On the other hand, the rotating shaft 610 is connected to the first gear 81, and receives the driving force from the first gear 81 to be rotated.

Further, the second transport member 700 is configured in the same manner as the first transport member 600, and includes a rotating shaft 710 arranged along the longer direction of the toner accommodation portion 400 to be rotated, and a seat member 720 which is formed of a resin material such as PET, is in a thin plate shape, and is attached to the rotating shaft 710. Here, the seat member 720 pushes out the toner accommodated in the toner accommodation portion 400 toward the first transport member 600. Here, the rotating shaft 710 of the second transport member 700 is connected to the third gear 83, and receives the driving force from the third gear 83 to be rotated.

On the other hand, when the toner is transported by the first transport member 600 and the second transport member 700, the first transport member 600 and the second transport member 700 are rotated in the direction indicated by an arrow 3A in the drawing. In other words, in the case of seeing the toner accommodation portion 400 from the direction indicated by an arrow 3B in the drawing, the first transport member 600 and the second transport member 700 are rotated in the counterclockwise direction.

Then, a third side wall 403 and a fourth side wall 404 provided in the toner accommodation portion 400 will be described. As shown in FIG. 3, the third side wall 403 includes a first region 403A positioned on the side of the second side wall 402, a second region 403B connected to the first region 403A and positioned on the side of the first side wall 401 than the first region 403A, and a third region 403C connected to the second region 403B and positioned on the side of the first side wall 401 than the second region 403B Here, the first region 403A is arranged along the longer direction of the toner accommodation portion 400 and is provided on the side close to the fourth side wall 404 than the third region 403C. Further, the second region 403B is slantingly arranged with respect to the longer direction of the toner accommodation portion 400, and moves from the side where the first side wall 401 is provided to the side where the second side wall 402 is provided to approach the side of the fourth side wall 404. Further, the third region 403C is arranged along the longer direction of the toner accommodation portion 400 and is connected to the first side wall 401.

On the other hand, the fourth side wall 404 is configured by five regions of the first to fourth regions 404A to 404E. Here, the first region 404A is arranged along the longer direction of the toner accommodation portion 400 and is connected to the second side wall 402.

Further, the second region 404B is connected to the end portion of the first region 404A (end portion on the side of the first side wall 401) and is arranged to be orthogonal to the first region 404A. Further, the second region 404B is provided on the side that is apart from the third side wall 403 than the first region 404A. Further, the third region 404C is connected to the second region 404B and is prepared on the side of the first side wall 401 than the second region 404B. Further, the third region 404C is provided on the side that is apart from the third side wall 403 than the second region 404B.

Further, the fourth region 404D is connected to the third region 404C and is provided on the side of the first side wall 401 than the third region 404C. Further, the fourth region 404D is provided on the side that is apart from the third side wall 403 than the third region 404C. Further, the fourth region 404D is slantingly arranged with respect to the longer direction of the toner accommodation portion 400, and moves from the side where the first side wall 401 is provided to the side where the second side wall 402 is provided to approach the side of the third side wall 403.

Further, the fifth region 404E is connected to the fourth region 404D, and is provided on the side of the first side wall 401 than the fourth region 404D. Further, the fifth region 405E is provided on the side that is apart from the third side wall 403 than the fourth region 404D.

Here, in this embodiment, as a result of forming the third side wall 403 and the fourth side wall 404 as described above, dimensions in the width direction of the toner accommodation portion 400 (width dimensions, dimensions in the direction that is orthogonal to the longer direction) differ in the longer direction of the toner accommodation portion 400. More specifically, the dimensions in the width direction of the toner accommodation portion 400 becomes smaller progressively as the toner accommodation portion 400 is directed from the side where the first side wall 401 is positioned to the side where the second side wall 402 is positioned. More specifically, according to this embodiment, since the dimensions in the width direction of the toner accommodation portion 400 differ, the cross section of the toner accommodation portion 400 (toner cartridge 68Y) becomes smaller progressively as the toner accommodation portion 400 is directed from the side where the first side wall 401 is positioned to the side where the second side wall 402 is positioned.

More specifically, in a portion where the third region 403C of the third side wall 403 and the fifth region 404E of the fourth side wall 404 face each other, the dimensions in the width direction of the toner accommodation portion 400 have become dimensions L1. On the other hand, in a portion where the first region 403A of the third side wall 403 and the third region 404C of the fourth side wall 404 face each other, the dimensions in the width direction of the toner accommodation portion 400 have become dimensions L2 that are smaller than the dimensions L1. Further, in a portion where the first region 403A of the third side wall 403 and the first region 404A of the fourth side wall 404 face each other, the dimensions in the width direction of the toner accommodation portion 400 have become dimensions L3 that are smaller than the dimensions L2.

As shown as a reference numeral 3C in FIG. 3, the first region 403A of the third side wall 403 projects from the end portion in the longer direction of the toner accommodation portion 400 to the outside, and thus the distance between the first region 403A of the third side wall 403 and the first region 404A of the fourth side wall 404 increases at the end portion of the toner accommodation portion 400. However, a partition 406 is provided on the inside of the first region 403A of the third side wall 403, and thus the actual dimensions of the toner accommodation portion 400 in the portion where the first region 403A of the third side wall 403 and the first region 404A of the fourth side wall 404 face each other, as described above, have become dimensions L3 that are smaller than the dimensions L2.

Figure 4:
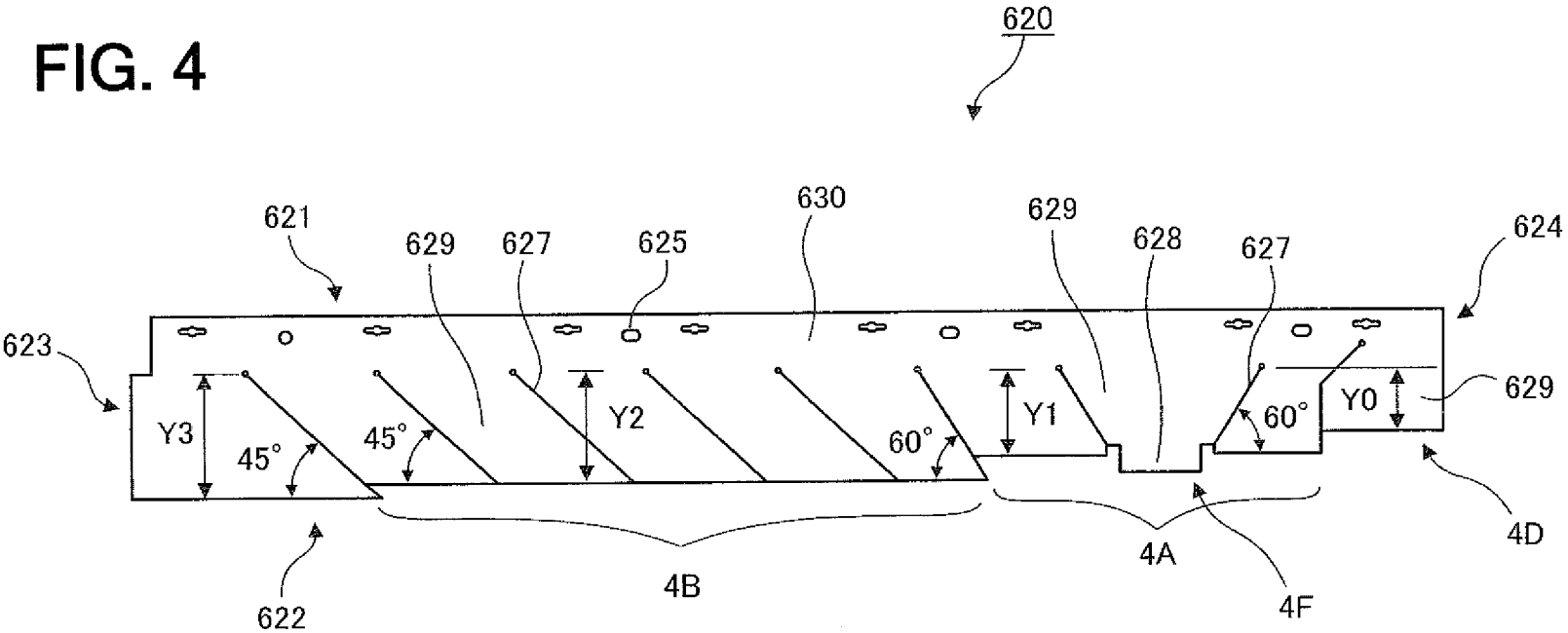
FIG. 4 is a front view of a seat member provided on a first transport member.

FIG. 4 is a front view of a seat member 620 provided on a first transport member 600.

As an example of a flexible member, the seat member 620 is formed of a resin material, and has flexibility (elasticity). Further, the seat member 620 is in a thin plate shape. Further, the seat member 620 is in a rectangular (belt) shape, and has first to fourth side cut portions 621 to 624 provided on the circumference of the seat member 620.

Here, the seat member 620 is arranged so that the first and second side cut portions 621 and 622 go along the longer direction of the toner accommodation portion 400. Further, the seat member 620 is arranged so that the longer direction of the seat member 620 goes along the rotating shaft 610 (see FIG. 3), and the side of the first side cut portion 621 that is positioned at one end portion in the width direction of the seat member 620 is attached to the rotating shaft 610. That is, the seat member 620 is attached to the rotating shaft 610 so that the side of the second side cut portion 622 that is positioned at the other end portion in the width direction of the seat member 620 has become a free end. Further, the seat member 620 is arranged so that the third side cut portion 623 is positioned on the side of the first side wall 401 (see FIG. 3) of the toner accommodation portion 400, and the seat member 620 is arranged so that the fourth side cut portion 624 is positioned on the side of the second side wall 402 of the toner accommodation portion 400.

Further, according to this embodiment, a plurality of through-holes 625 are formed in an area that is adjacent to the first side cut portion 621 of the seat member 620 and is in a belt shape that goes along the first side cut portion 621. In this embodiment, projections 614 (see FIG. 3) provided on the rotating shaft 610 are inserted into the through-holes 625 to fix the seat member 620 to the rotating shaft 610.

Further, on the seat member 620, a plurality of slits 627, which start from the second side cut portion 622 toward the side of the first side cut portion 621, are formed. Further, in this embodiment, since the plurality of slits 627 are provided, the seat member 620 has bent pieces 629 provided between the adjacent slits 627. The bent pieces 629 has a free end that is the side of the second side cut portion 622 and a fixed end that is the side of the first side cut portion 621 and is bent (elastically deformed). On the other hand, plural bent pieces 629 are provided. Here, the bent piece 629 is a region that is positioned on the side of the first side cut portion 621 of the seat member 620, and is supported by a rectangular-shaped (belt-shaped) region (hereinafter referred to as a "base portion") arranged to go along the first side cut portion 621.

Here, in this embodiment, one of the plurality of bent pieces 629 (bent piece 629 indicated by a reference numeral 4F in FIG. 4) is arranged in an opposite position to the toner discharge port 405A (see FIG. 3), and this bent piece 629 (hereinafter referred to as an "opposite bent piece 629") pushes out the toner toward the toner discharge port 405A when the rotating shaft 610 is rotated. On the other hand, at a front end of the opposite bent piece 629, a projection portion 628 that projects toward the direction that is apart from the opposite bent piece 629 is formed.

On the other hand, in this embodiment, the slits 627 are slantingly arranged with respect to the rotating shaft 610, and the slit 627 that is positioned on the side of the third side cut portion 623 than the opposite bent piece 629 is directed from the second side cut portion 622 to the first side cut portion 621 to approach the side of the third side cut portion 623. Further, the slit 627 that is positioned on the side of the fourth side cut portion 624 than the opposite bent piece 629 is directed from the second side cut portion 622 to the first side cut portion 621 to approach the side of the fourth side cut portion 624. More specifically, in this embodiment, the slits 627 are slantingly formed to be directed from the second side cut portion 622 as a start point toward the side of the first side cut portion 621, and further to be directed toward the upstream side in the transport direction of the toner through the first transport member 600 (see FIG. 3).

Further, in this embodiment, the lengths of the bent pieces 629 differ depending on the regions where the bent pieces 629 are arranged. Specifically, the length of three bent pieces 629 (three bent pieces 629 indicated by reference numeral 4A in FIG. 4) arranged on the opposite region of the third region 404C of the fourth side wall 404 (see FIG. 3) of the plurality of bent pieces 629 is set to dimensions Y1. On the other hand, the length of five bent pieces 629 (five bent pieces 629 indicated by reference numeral 4B in FIG. 4) arranged on the opposite region of the fourth and fifth regions 404D and 404E of the fourth side wall 404 of the bent pieces 629 is set to dimensions Y2 that are larger than the dimensions Y1.

Here, in this embodiment, if the fourth and fifth regions 404D and 404E of the fourth side wall 404 are positioned on the side that is apart from the third side wall 403 than the third region 404C, and the lengths of all the bent pieces 629 are the same, it becomes difficult to transport the toner that is positioned on the opposite region of the fourth and fifth regions 404D and 404E. Because of this, in this embodiment, as described above, the length of the five bent pieces 629 arranged on the opposite region of the fourth and fifth regions 404D and 404E is set to be larger than the length of the three bent pieces 629.

On the other hand, in this embodiment, one of the bent pieces 629 that is positioned on the left side than the five bent pieces 629 in the drawing has the length of dimensions Y3 that are larger than dimensions Y2. Through this, in this embodiment, the toner that may be delayed in the corner portion of the toner accommodation portion 400 is scraped out. Further, in this embodiment, one of the bent pieces 629 (one bent piece 629 indicated by reference numeral 4D in FIG. 4) arranged on the opposite region to the first region 404A of the fourth side wall 404 has the length of dimensions Y0 that are smaller than dimensions Y1.

Further, in this embodiment, the angles of the plurality of slits 627 with respect to the second side cut portion 622 differ depending on the positions in which the slits 627 are provided.

Specifically, the angle of two slits 627 that are positioned on the left and right of the one of the three bent pieces 629 (three bent pieces 629 indicated by reference numeral 4A) that is positioned in the center in the drawing is set to 60°. Further, the angle of the slit 627 that is positioned between the bent piece 629 that is positioned on the leftmost side of the three bent pieces 629 in the drawing and the bent piece 629 that is positioned on the rightmost side of the five bent pieces 629 in the drawing is set to 60°.

On the other hand, the angle of the four silts 627 formed in order to form the five bent pieces 629 with respect to the second side cut portion 622 is set to 45°. Further, the slit 627 that is positioned between the bent piece 629 positioned at the left end of the five bent pieces 629 and one bent piece 629 positioned on the left side of the bent piece 629 is formed at 45°.

Figure 5:
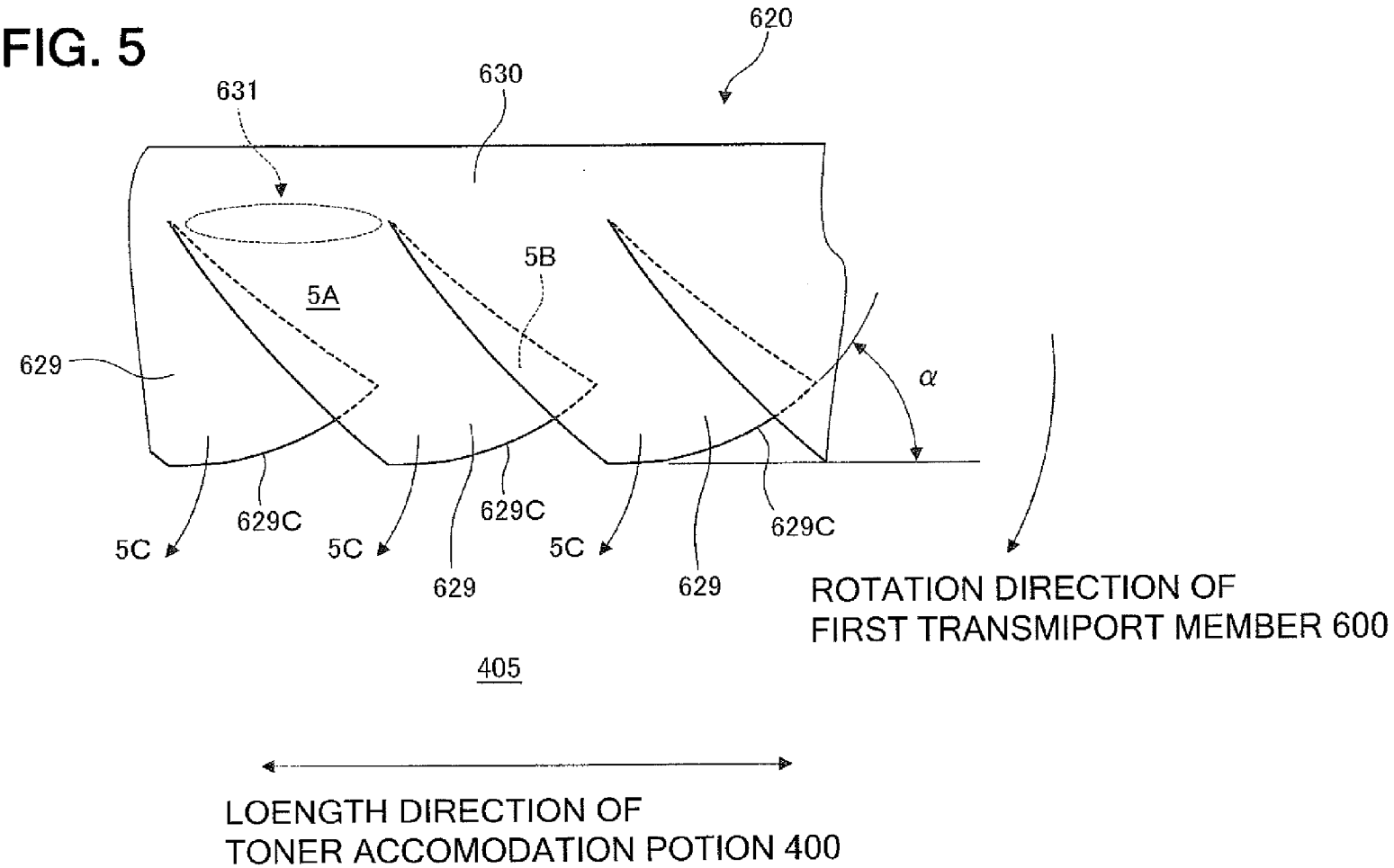
FIG. 5 is a view explaining movement of bent piece.

Here, referring to FIG. 5 (drawing for explaining the movement of the bent piece 629), the movement of the bent piece 629 when the toner is transported will be described. On the other hand, FIG. 5 illustrates the state of the bent piece 629 when the free end side of the bent piece 629 is positioned on the lower side and the toner on the bottom plate 405 is pushed out to the side of the fourth side wall 404 (see FIG. 3). Further, FIG. 5 illustrates three bent pieces 629 included in the five bent pieces 629. On the other hand, in FIG. 5, the illustration of the toner is omitted.

In this embodiment, since the slits 627 are slantingly arranged as described above, the rigidity of the bent piece 629 differs in each region of the bent piece 629. Specifically, since the region that is positioned on the lower side of a connection portion 631 between the base portion 630 and the bent piece 629, of the bent pieces 629 and is supported by the connection portion 631 (region indicated by reference numeral 5A, hereinafter referred to as a "supported region 5A") is close to the base portion 630, it has high rigidity and is difficult to be deformed. On the other hand, the region that is apart from the lower side of the connection portion 631 (region indicated by reference numeral 5B, hereinafter referred to as an "outside region 5B") is apart from the base portion 630, and thus it is liable to be deformed.

As a result, since the outside region 5B is liable to be deformed when the bent piece 629 pushes out the toner, the outside region 5B is bent greater than the region 5A to be supported. Further, in this case, as shown in FIG. 5, a front edge 629C that is positioned on the free end side of the bent piece 629 is slanted with respect to the longer direction of the toner accommodation unit 400.

That is, when the bent piece 629 pushes out the toner, the front edge 629C of the bent piece 629 is slanted so that the side of the bent piece 629 that is close to the toner discharge port 405A is positioned on the upstream side in the rotating direction of the first transport member 600 and the side of the bent piece 629 that is apart from the toner discharge port 405A is positioned on the downstream side in the rotating direction. In this case, the toner is pushed out in the direction (the downstream side in the rotating direction of the first transport member 600) indicated by an arrow 5C in the drawing, and is pushed out toward the toner discharge port 405A.

On the other hand, in FIG. 5, the state of the bent piece 629 that is positioned on the side of the third side cut portion 623 than the opposite bent piece 629 is illustrated. However, event in the case of the bent piece 629 that is positioned on the side of the fourth side cut portion 624 (see FIG. 4) than the opposite bent piece 629, during the transport of the toner, as described above, the front edge 629C is slanted. Specifically, the front edge 629C of the bent piece 629 is slanted so that the side that is close to the tone discharge port 405A is positioned on the upstream side in the rotating direction of the first transport member 600 and the side that is apart from the toner discharge port 405A is positioned on the downstream side in the rotating direction. Through this, even the toner that is positioned on the side of the fourth side cut portion 624 than the opposite bent piece 629 is moved toward the toner discharge port 405A.

Then, a seat member 720 provided on the second transport member 700 will be described.

Figure 6:
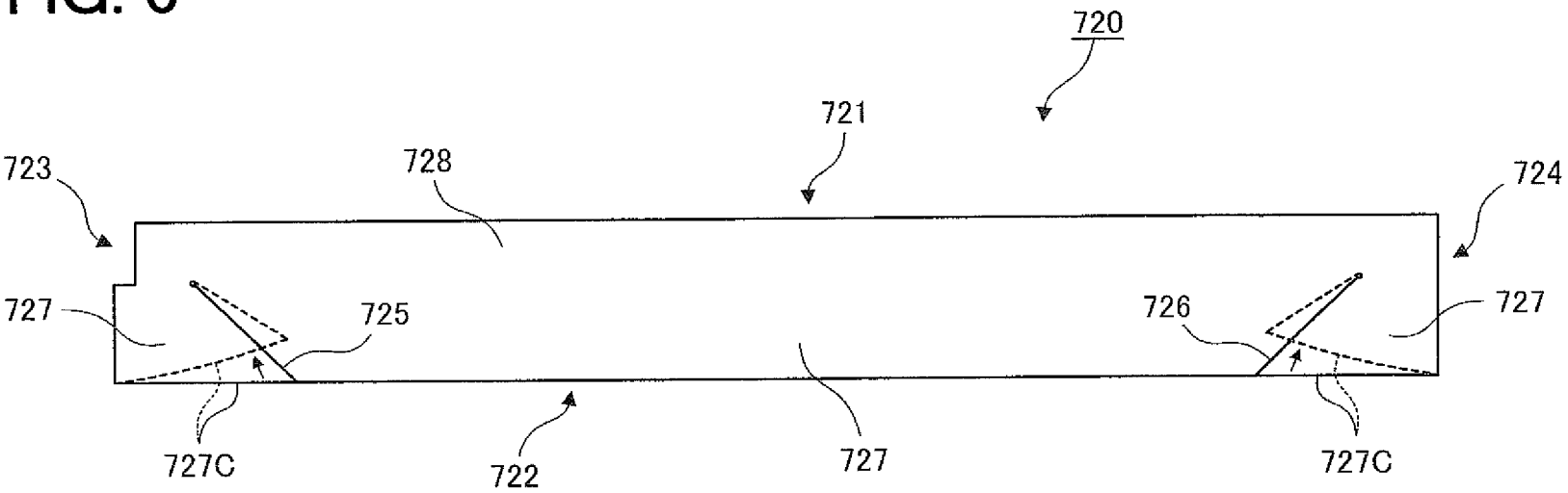
FIG. 6 is a view illustrating a seat member provided on a second transport member.

FIG. 6 is a view illustrating the seat member 720 provided on the second transport member.

Here, the seat member 720 provided on the second transport member 700 is formed of a resin material, and has flexibility (elasticity) in the same manner as the above-described seat member 620. Further, the seat member 720 is in a thin plate shape. Further, the seat member 720 is in a rectangular shape, and has first to fourth side cut portions 721 to 724 provided on the circumference of the seat member 720.

Here, in the same manner as the seat member 620, the seat member 720 is arranged so that the first and second side cut portions 721 and 722 go along the longer direction of the toner accommodation portion 400. Further, the seat member 720 is arranged so that the third side cut portion 723 is positioned on the side of the first side wall 401 (see FIG. 3) of the toner accommodation portion 400 and the fourth side end portion 724 is positioned on the side of the second side wall 402 of the toner accommodation portion 400. Further, in the same manner as the seat member 620, the seat member 720 has the first side end portion 721 that is fixed to the rotating shaft 710 (see FIG. 3).

Here, the seat member 720 has two slits of a first slit 725 and a second slit 726. Here, the first slit 725 is one end portion in the longer direction of the seat member 720, and is provided at an end portion that is positioned on the side of the third side cut portion 723. Further, the second slit 726 is the other end portion in the longer direction of the seat member 720, and is provided at the end portion that is positioned on the side of the fourth side cut portion 724.

Further, in this embodiment, by providing the first slit 725 and the second slit 726, three bent pieces 727 and a base portion 728 supporting the three bent pieces 727 are provided. On the other hand, the first slit 725 is directed from the side of the second side cut portion 722 to the side of the first side cut portion 721 to approach the third side cut portion 723. Further, the second slit 726 is directed from the side of the second side cut portion 722 to the side of the first side cut portion 721 to approach the fourth side cut portion 724.

Here, the transport of the toner by the second transport member 700 is performed in a manner that the seat member 720 pushes out the toner toward the first transport member 600. More specifically, by moving the seat member 720 from the inside of the sheet surface in FIG. 6 to the front side, the toner on the bottom plate 405 (see FIG. 3) is pushed out toward the first transport member 600, and thus the toner is supplied to the first transport member 600.

On the other hand, two bent pieces positioned at both ends in the drawing, of three bent pieces 727 move the toner that is positioned on the corner of the toner accommodation portion 400 to the side of the center portion of the toner accommodation portion 400 (the side of the center portion in the longer direction of the toner accommodation portion 400). Specifically, as described above, the front edges 727C of the two bent pieces 727 are slanted with respect to the longer direction of the toner accommodation portion 400 as shown as a dotted line in the drawing, and through this slanting, the toner that is positioned on the corner of the toner accommodation portion 400 is moved to the side of the center portion of the toner accommodation portion 400.

Figure 7:
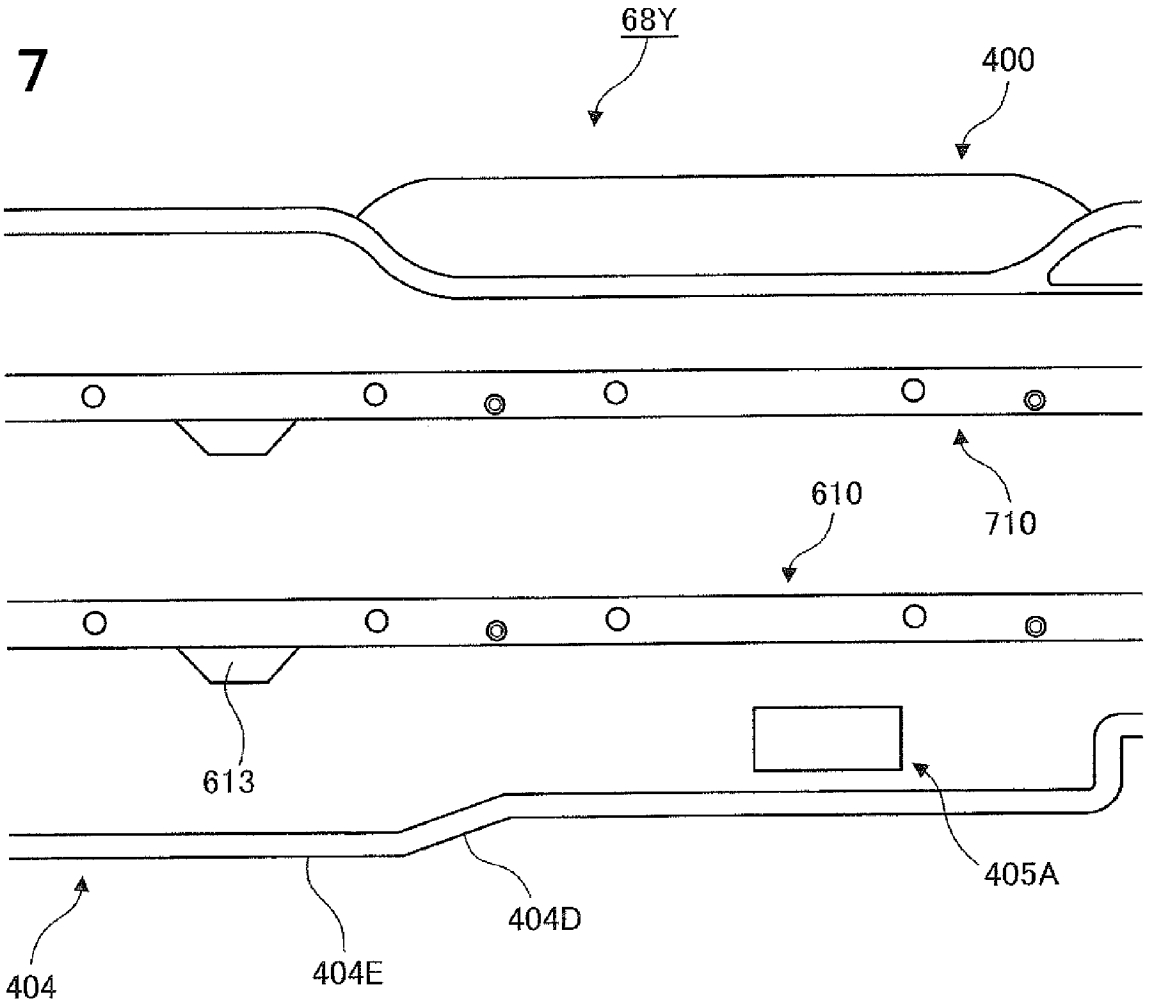
FIG. 7 is a top view illustrating a seat member and a toner accommodation portion from which the seat member has been removed.
Figure 8:
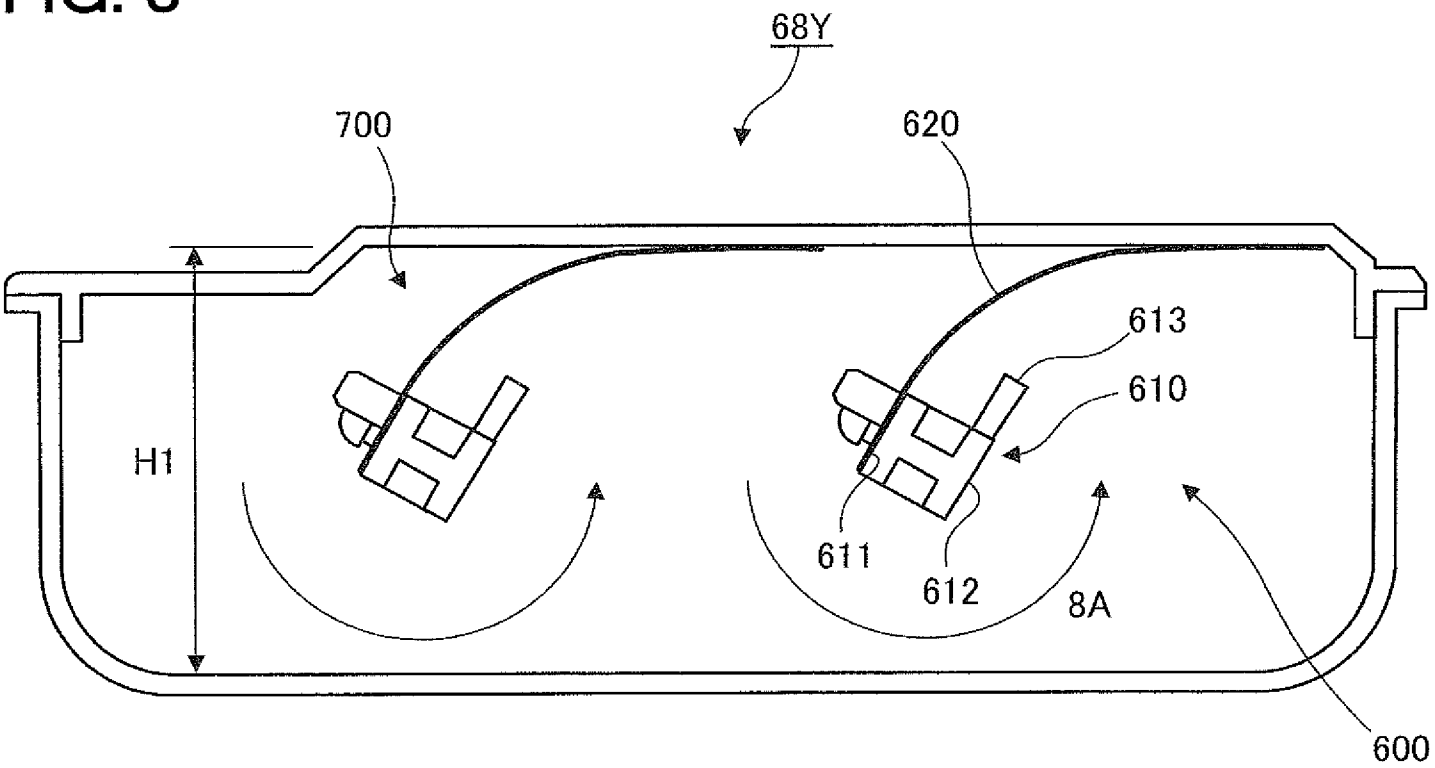
FIG. 8 is a cross-sectional view taken along line VIII-VIII in FIG. 2.
Figure 9:
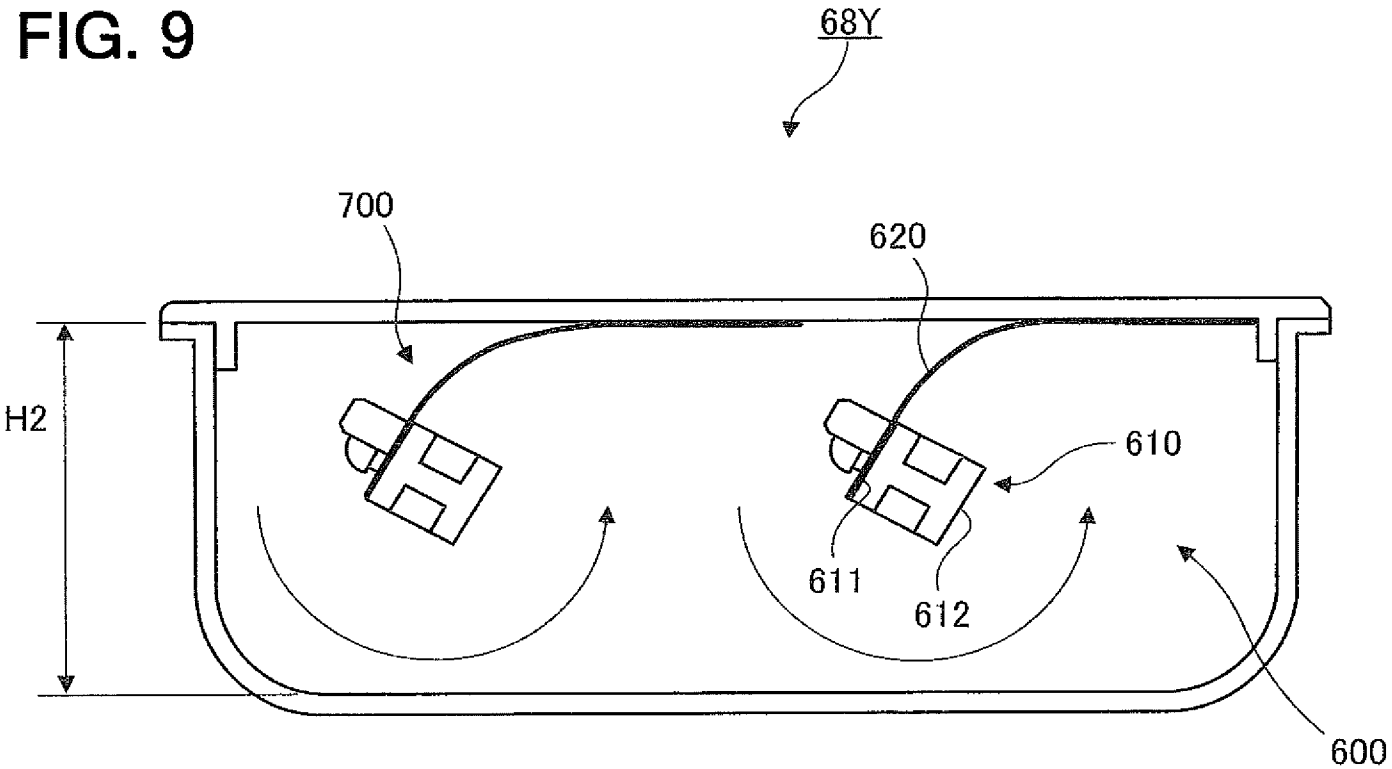
FIG. 9 is a cross-sectional view taken along line IX-IX in FIG. 2.

Then, referring to FIGS. 7 to 9, the rotating shaft 610 provided on the first transport member 600 and the rotating shaft 710 provided on the second transport member 700 will be described. On the other hand, FIG. 7 is a top view illustrating the seat member 620 and the toner accommodation portion 400 from which the seat member 720 has been removed. FIG. 8 is a cross-sectional view taken along line VIII-VIII in FIG. 2, and FIG. 9 is a cross-sectional view taken along line IX-IX in FIG. 2. On the other hand, since the rotating shaft 610 and the rotating shaft 710 are configured in the same manner, in the following description, the description of the rotating shaft 610 will be made while the description of the rotating shaft 710 will be omitted.

As shown in FIG. 7, the rotating shaft 610 is arranged along the longer direction of the toner accommodation portion 400. Further, as shown in FIGS. 8 and 9, the rotating shaft 610 is formed to have an "H"-shaped cross section, and includes a first side surface 611 and a second side surface 612 positioned on the opposite side to the first side surface 611. On the other hand, the above-described projection 614 (see FIG. 3) is formed on the first side surface 611, and the seat member 620 is attached to go along the first side surface 611.

On the rotating shaft 610 according to this embodiment, as shown in FIGS. 7 and 8, a support projection 613 positioned in the rear of the seat member 620 to support the seat member 620 is provided. That is, the support projection 613 is arranged on the upstream side than the seat member 620 in the rotating direction (see an arrow 8A in FIG. 8) of the rotating shaft and supports the rear of the seat member 620 that is bent through pressing by the toner. The support projection 613 is formed to project from the rotating shaft 610 in the direction that is parallel to the first side surface 611 to which the seat member 620 is attached.

Specifically, in this embodiment, the toner is pressed by one side surface of the seat member 620 to be transported, and at this time, the seat member 620 is bent. The support projection 613 is in contact with the seat member 620 on the surface of the other side of the bent seat member 620. Through this, excessive bending of the seat member 620 is restrained, and thus the drop of the toner transport capacity can be reduced. On the other hand, the support projection 613, as shown in FIG. 7, is provided on the side of the fifth region 404E than the fourth region 404D of the fourth side wall 404. That is, the support projection 613 is provided on the region that is opposite to the fifth region 404E.

However, in the case where the toner is supplied from the toner cartridge 68Y, it is preferable that the toner is stably discharged from the toner discharge port 405A (it is preferable that the toner discharge amount is not changed). Here, in order to stably discharge the toner from the toner discharge port 405A, it is important to heighten the density of the toner surrounding the toner discharge port 405A. If the density of the toner is low, an irregularity may occur in the amount of the toner discharged from the toner discharge port 405A.

In this embodiment, in order to stabilize the toner discharge amount (in order to heighten the density of toner around the toner discharge port 405A), as described above, the dimensions in the width direction of the toner accommodation portion 400 is narrowed progressively. Specifically, the dimensions of a portion where the toner discharge port 405A is positioned are narrowed in comparison to the upstream side by setting the dimensions (dimensions in the width direction) of a portion that is positioned on the upstream side (upstream side in the transport direction of the toner by the first transport member 600) than the toner discharge port 405A in the toner accommodation portion 400 to dimensions L1 as described above, and by setting the dimensions of the portion in which the toner discharge port 405A is positioned to dimensions L2 as described above.

That is, if the cross section on the surface that crosses (that is orthogonal to) the transport direction of toner by the first transport member 600 is set to a first cross section as the cross section of the portion that is positioned on the upstream side than the toner discharge port 405A of the toner accommodation portion 400, the cross section of the portion in which the toner discharge port 405A is positioned is set to a second cross section that is smaller than the first cross section, so that the dimensions of the portion where the toner discharge port 405A is positioned are narrowed in comparison to the upstream side. Further, the angle with respect to the second side end portion 622 is changed depending on the cross section of the five bent pieces 629 of the seat member 620.

Through this, the density of the toner is heightened in the portion where the toner discharge port 405A is positioned, and thus the toner discharge amount is stabilized. On the other hand, if the dimensions (dimensions in the width direction) of the toner accommodation portion 400 are progressively narrowed as described above, a corner portion occurs in the connection portion between the portion having wide width and the portion having narrow width, and the toner may be collected in the corner portion. Because of this, in this embodiment, as described above, the fourth region 404D of the fourth side wall 404 (see FIG. 3) and the second region 403B of the third side wall 403 are configured to be slanted with respect to the longer direction of the toner accommodation portion 400 to prevent the corner portion from occurring.

On the other hand, although the explanation thereof has been omitted, in the toner cartridge 68Y according to this embodiment, the dimensions in the height direction of the toner cartridge 68Y differ between the portion in which the toner discharge port 405A is positioned and the portion that is positioned on the upstream side than the toner discharge port 405A. More specifically, in the portion that is positioned on the upstream side than the toner discharge port 405A, as shown in FIG. 8, the dimensions in the height direction are set to dimensions H1. On the other hand, in the portion in which the toner discharge port 405A of the toner cartridge 68Y is positioned, as shown in FIG. 9, the dimensions in the height direction are set to dimensions H2 that are smaller than the dimensions H1.

Through this, in this embodiment, the density of the toner in the portion where the toner discharge port 405A is positioned can be further improved in comparison to a case where the height dimensions of the toner cartridge 68Y are not changed. On the other hand, in the connection portion between the portion that is formed with dimensions H1 of the toner cartridge 68Y and the portion that is formed with dimensions H2 of the toner cartridge 68Y, as shown in FIG. 2, a slant portion 520, which has a height that decreases gradually as the slant portion 520 is directed from the side of the first side wall 401 to the side of the second side wall 402, is provided to achieve a smooth flow of the toner that moves toward the side of the second side wall 402.

However, as described above, if the widths of the toner accommodation portions 400 between the portion in which the toner discharge port 405A is positioned (hereinafter referred to as the "discharge port installation portion") and the portion that is positioned on the upstream side than the above-described portion (hereinafter referred to as the "upstream side portion") are different from each other, the toner is concentrated in the connection portion between the discharge port installation portion and the upstream side portion. In this case, through this connection portion, pressure is applied to the seat member 620 of the first transport member 600 and the seat member 720 of the second transport member 700, and thus the seat member 620 and the seat member 720 become easy to be bent. Further, in this case, the toner transport capacity is lowered, and thus the toner transport amount in the connection portion is liable to be lowered.

Because of this, in this embodiment, as described above, the seat member 620 and the support projection 613 (see FIG. 7) positioned in the rear of the seat member 720 to support the seat member 720 are provided. In this case, the great bending of the seat member 620 and the seat member 720 is restrained, and thus the drop of the toner transport capacity can be reduced.

Further, in this embodiment, as described above, the angles of the plurality of slits 627 provided on the seat member 620 to the second side cut portion 622 differ depending on the regions having the slits 627 provided thereon. Specifically, as described above, the angle of two slits 627 that are positioned on the left and right of the bent piece 629 positioned in the center of three bent pieces 629 (three bent pieces 629 indicated by reference numeral 4A in FIG. 4) is set to 60°. Further, the angle of the slit 627 that is positioned between the bent piece 629 positioned on the leftmost side of the three bent pieces 629 in FIG. 4 and the bent piece 629 positioned on the rightmost side of the five bent pieces 629 (five bent pieces 629 indicated by reference numeral 4B in FIG. 4) is set to 60°.

On the other hand, the angle of the four slits 627 that are formed to form the five bent pieces 629 to the second side cut portion 622 is set to 45°. Further, the angle of the slit that is positioned between the bent piece 629 positioned on the leftmost side of the five bent pieces 629 in FIG. 4 and one bent piece 629 positioned on the left side of the bent piece 629 is set to 45°.

More specifically, in this embodiment, considering the connection portion between the discharge port installation portion and the upstream side portion as a boundary, the angle of the slit 627 that is positioned on the upstream side (the side of the first side wall 401) than the connection portion is set to 45°. On the other hand, the angle of the slit 627 that is positioned on the downstream side (the side of the second side wall 402) than the connection portion is set to 60°. That is, in this embodiment, considering the region in which the connection portion between the discharge port installation portion and the upstream side portion is positioned as a boundary, the angles of the slits 627 between the upstream side and the downstream side are set to be different from each other. More specifically, in this embodiment, an angle change point is provided in the region in which the connection portion is positioned.

Here, in this embodiment, as described above, it is preferable that the density of the toner around the toner discharge port 405A has become high. For this, in this embodiment, the angle of the slit 627 positioned in the upstream side portion is set to 45° to increase the amount of the toner that moves toward the toner discharge port 405A. Here, if the angle of the slit 627 is set to 45° rather than 60°, the slant angle □ (the slant angle of the front edge 629C to the longer direction of the toner accommodation portion 400) as shown in FIG. 5 becomes larger. In this case, more toner moves toward the longer direction of the toner accommodation portion 400, and thus the amount of the toner that moves toward the toner discharge port 405A increases.

On the other hand, if the angle of the slit 627 that is positioned in the discharge port installation portion is set to 45°, the force to push out the toner toward the longer direction of the toner accommodation portion 400 grows big, and thus the toner becomes easy to be pushed with respect to the second side wall 402 of the toner accommodation portion 400 (see FIG. 3) or the second region 404B of the fourth side wall 404. In this case, it is easy to cause cohesion of the toner. Because of this, in this embodiment, the angle of the slit 627 that is positioned in the discharge port installation portion is set to 60° to weaken the force to push out the toner toward the longer direction of the toner accommodation portion 400.

Further, although the description has been omitted as described above, in this embodiment, a narrow width portion having a narrower width is additionally formed on the opposite side to the upstream side portion across the discharge port installation portion. That is, in the transport direction of the toner by the first transport member 600, the narrow width portion having a smaller cross section (cross section on the surface that is orthogonal to the transport direction of the toner by the first transport member 600) than the discharge port installation portion is formed on the downstream side than the discharge port installation portion.

To explain concretely with reference to FIG. 3, the narrow width portion, of which the right end portion is shown in the drawing, is formed between the partition 406 and the first region 404A of the fourth side wall 404. Here, the dimensions of the narrow width portion in the width direction of the toner accommodation portion 400, as described above, are set to dimensions L3, which are smaller than the dimensions L2 of the discharge port installation portion.

However, the toner cartridge 68Y may be slanted during the transport of the toner cartridge 68Y to cause the toner to move along the longer direction of the toner cartridge 68Y. In this case, the toner is bumped against the first side wall 401 or the second side wall 402 of the toner accommodation portion 400. In such a situation, in the toner cartridge 68Y in this embodiment, the toner is concentrated in the narrow width portion, and the density of the toner in the narrow width portion is heightened. That is, in the toner cartridge 68Y according to this embodiment, the toner is concentrated in the narrow width portion, and the density of the toner in the narrow width portion becomes higher than the density of the toner that is positioned in the discharge port installation portion. In this embodiment, under the assumption that the toner cartridge 68Y is slanted downward from the side of the second side wall 402, the toner discharge port 405A is not installed in the narrow width portion in which the density of the toner is unnecessarily heightened, but is installed in the portion which is adjacent to the narrow width portion and in which the first region 403A of the third side wall 403 and the third region 404C of the fourth side wall 404 face each other.

Here, in this embodiment, the toner cartridge 68Y is mounted in the apparatus body 10A in a state where the toner density is high in the narrow width portion, and when the toner is supplied from the toner cartridge 68Y, the toner in the high density region is slowly broken to be supplied to the portion in which the first region 403A of the third side wall 403 and the third region 404C of the fourth side wall 404 face each other. Thereafter, the broken toner is transported toward the toner discharge port 405A.

As a result, in the toner cartridge 68Y according to this embodiment, the drop of the toner discharge amount becomes hard to occur, and thus the amount of the toner that is supplied from the toner cartridge 68Y is further stabilized. Here, in the inside of the toner accommodation portion 400, there may be a portion in which the toner density is thin, and in this case, the amount of the toner that is discharged from the toner discharge port 405A may be dropped. As described above, if a portion having a high toner density occurs, the toner is slowly supplied, and thus the drop of the toner discharge amount below a predetermined amount becomes hard to occur.

Figure 10:
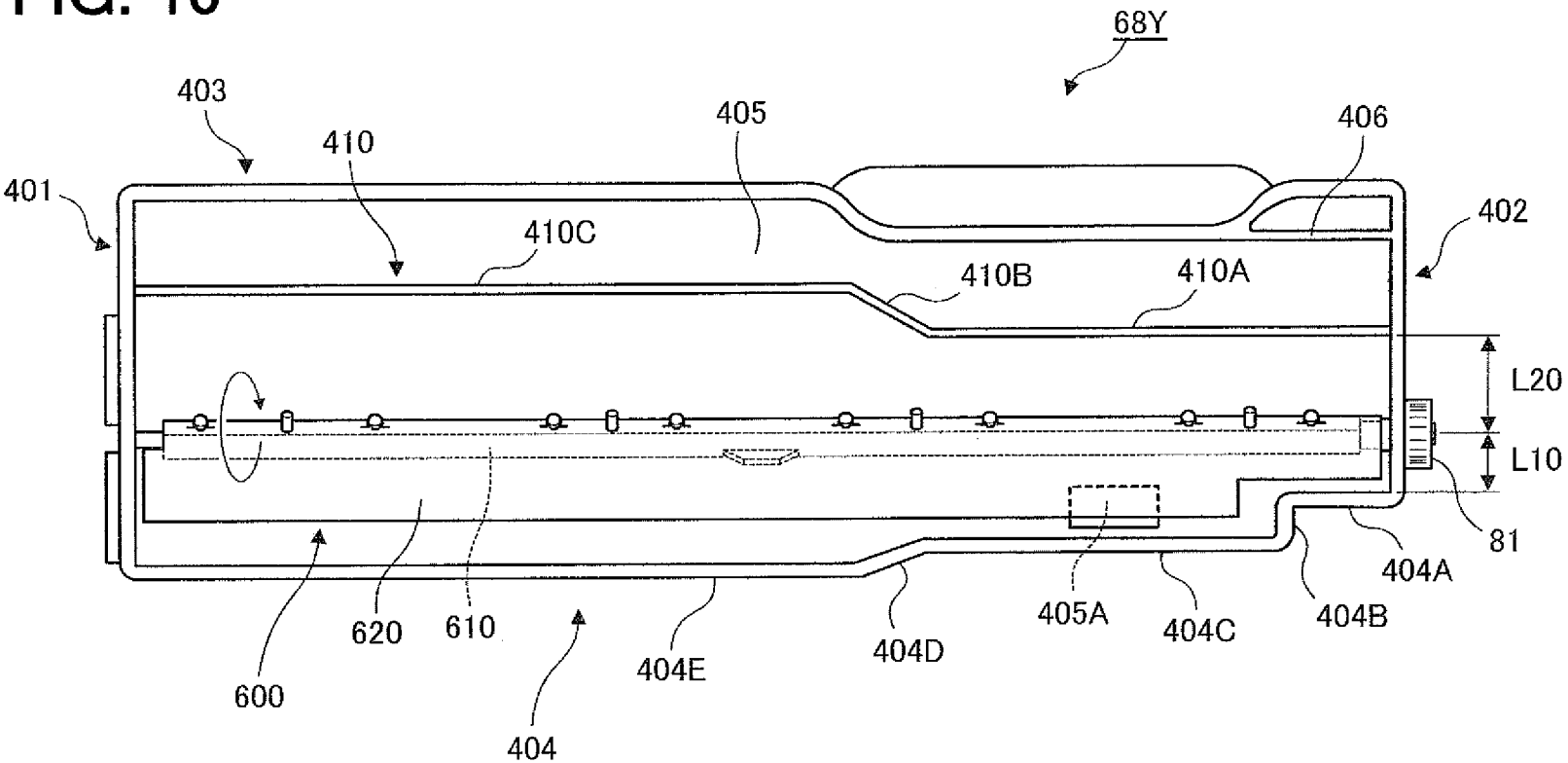
FIG. 10 is a view illustrating another configuration example of the toner cartridge.

On the other hand, it has been described that two transport members of the first transport member 600 and the second transport member 700 are provided. However, as shown in FIG. 10 (drawing illustrating another configuration example of the toner cartridge 68Y), the second transport member 700 may be omitted. In this configuration example, a partition 410 along the longer direction of the toner cartridge 68Y is formed in the inside of the third side wall 403, and the dimensions of the portion in which the toner in the toner accommodation portion 400 is actually accommodated (dimensions in the width direction of the toner accommodation portion 400) are set to be narrower than the dimensions in the configuration illustrated in FIG. 3. Through this, the toner can be transported to the toner discharge port 405A only through the first transport member 600.

In the configuration example as shown in FIG. 10, in the same manner as the configuration as shown in FIG. 3, a partition 410 includes a first region 410A, a second region 410B, and a third region 410C, and the width of the discharge port installation portion is set to be smaller than the width of the upstream side portion.

Further, in the configuration example, a rotating shaft 610 of the first transport member 600 is put to the side of the first region 404A of the fourth side wall 404. That is, the clearance L10 between the first region 404A of the fourth side wall 404 and the rotating shaft 610 is set to be smaller than the clearance L20 between the first region 410A of the partition 410 and the rotating shaft 610. More specifically, in this embodiment, the first transport member 600 is arranged in a state where the rotating shaft 610 is put to one side of the first region 404A of the fourth side wall 404 and the first region 410A of the partition 410.

Here, in the same manner as described above, a narrow width portion is formed between the first region 404A of the fourth side wall 404 and the first region 410A of the partition 410, and in the narrow width portion, the density of the toner is liable to become high. In this case, the toner is liable to cohere and become hard. Because of this, in this configuration example, by putting the rotating shaft 610 to one of the regions as described above, stirring of the toner is further performed. More specifically, even in this configuration example, although the stirring of the toner is performed by the bent piece 629 (see FIG. 4), the toner is broken more easily in the case where the base side of the bent piece 629 has a higher rigidity than the front end side thereof and the toner is stirred by a region that is close to the base. Because of this, in this embodiment, as described above, the rotating shaft 610 is put to one of the regions, and more toner is supplied to the base of the bent piece 629.

Figure 11:
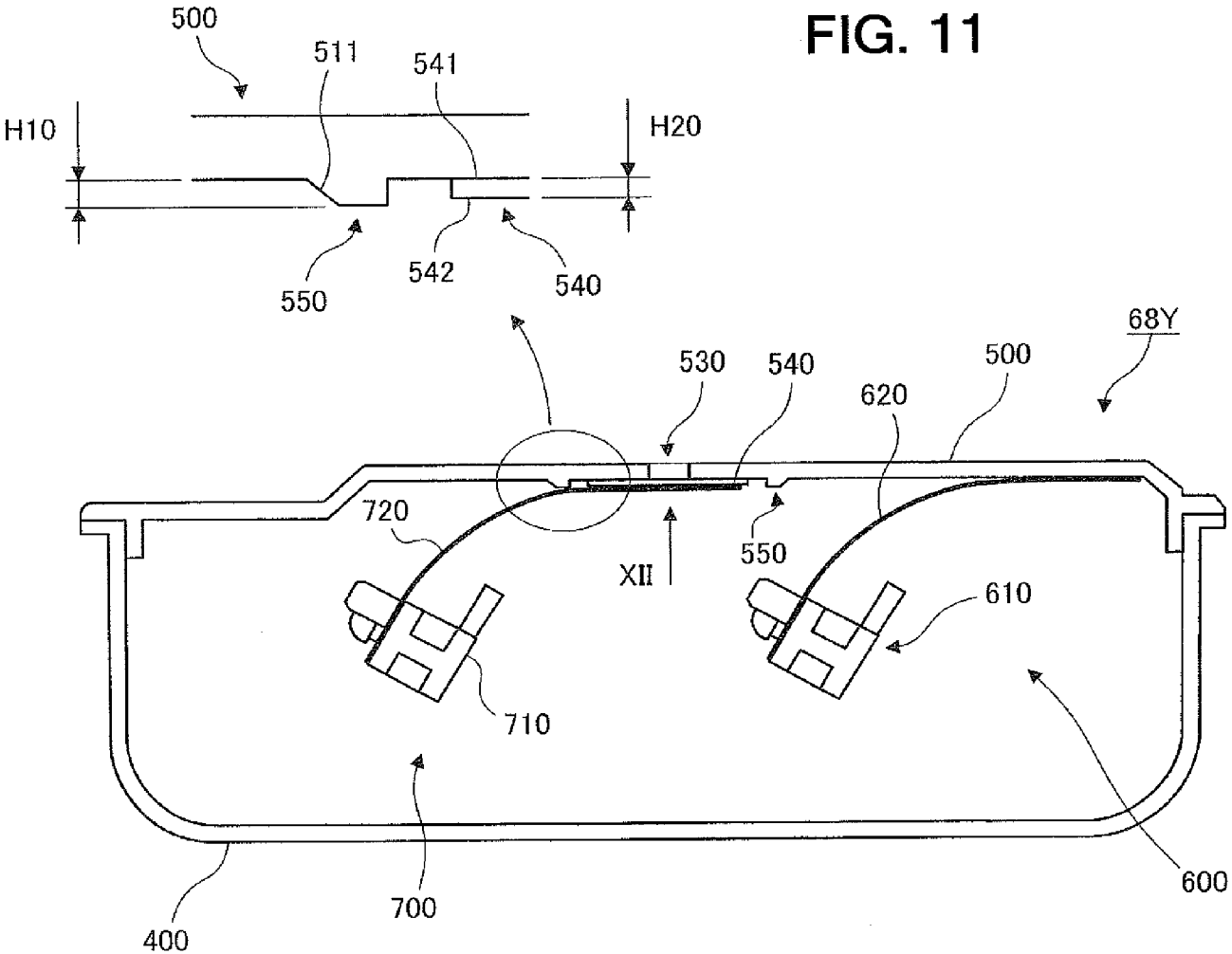
FIG. 11 is a cross-sectional view of the toner cartridge taken along line XI-XI in FIG. 2.
Figure 12:
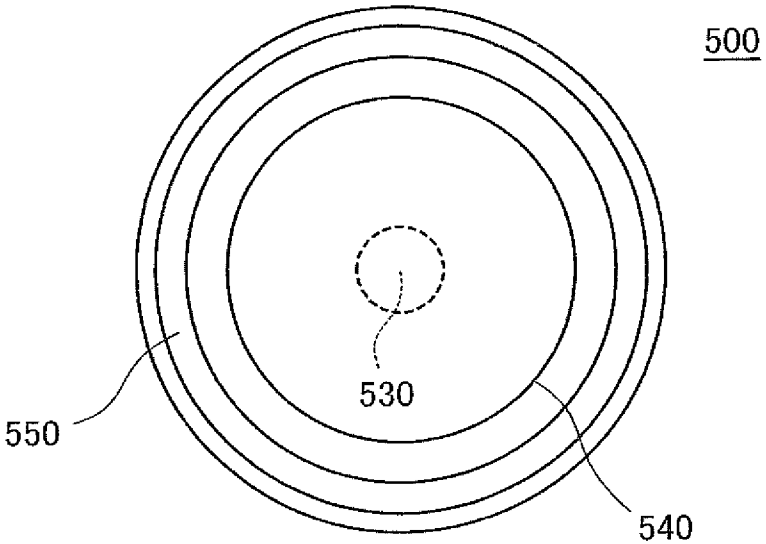
FIG. 12 is a view of a cover member of the toner cartridge as seen in the direction of an arrow XII in FIG. 11.

FIG. 11 is a cross-sectional view of the toner cartridge 68Y taken along line XI-XI in FIG. 2. Further, FIG. 12 is a view of a cover member 500 of the toner cartridge 68Y as seen in the direction of an arrow XII in FIG. 11. In FIG. 12, illustration of the seat member 720 illustrated in FIG. 11 has been omitted.

As shown in FIG. 11 and as described above, the cover member 500 has a through-hole 530 formed thereon to introduce air to the inside of the toner cartridge 68Y. Further, in this embodiment, in order to prevent the toner from leaking from the through-hole 530, a filter 540 which passes air but regulates the passing of the toner is provided in the inside than the through-hole 530.

Here, as shown in FIG. 11, the filter 540 is attached to the inner surface of the cover member 500. Further, this filter 540 includes a first surface 541, and a second surface 542 that is positioned on the opposite side to the first surface 541. The first surface 541 is attached to the inner surface of the cover member 500. On the other hand, as shown in FIG. 12, the through-hole 530 and the filter 540 are in a circular shape.

Although the description has been omitted as described above, in this embodiment, as shown in FIG. 2, on one end portion side in the longer direction of the toner cartridge 68Y, the toner discharge port 405A is formed, and on the other end portion side in the longer direction of the toner cartridge 68Y, the through-hole that communicates with the outside is formed. In this case, the toner is discharged more smoothly from the toner cartridge 68Y in comparison to a case where the through-hole 530 is formed on one end portion side (the same side as the side where the toner discharge port 405A is provided) in the longer direction of the toner cartridge 68Y.

Further, in this embodiment, as described above, the filter 540 is provided on the inside than the through-hole 530. That is, the filter 540 is attached to the inner surface that is positioned on the side of the toner accommodation portion 400 of the cover member 500 rather than an outer surface thereof that is positioned on the opposite side to the inner surface. Here, the filter 540 may be attached to the outer surface of the cover member 500. In this case, however, the toner may get into the inside of the through-hole 530 and block up the through-hole 530 that functions as a bleeder. Because of this, in this embodiment, the filter 540 is attached to the inner surface to prevent the toner from getting into the through-hole 530.

In this embodiment, during the manufacturing of the toner cartridge 68Y, the adjustment of the position of the seat member 720 of the second transport member 700 is preformed, and as shown in FIG. 11, a seat member 720 is arranged to face the filter 540 as an example of an elastic piece. More specifically, during the manufacturing of the toner cartridge 68Y, the first gear 81 (see FIG. 3) is rotated by a manufacturer or a manufacturing device, and the seat member 720 is arranged to face the filter 540.

The toner cartridge 68Y according to this embodiment is shipped in a state where the seat member 720 faces the filter 540. That is, the toner cartridge 68Y according to this embodiment is shipped in a state where the seat member 720 is positioned in an opposite region to the portion that faces the through-hole 530 of the filter 540, and then is conveyed (delivered) to a customer. More specifically, the toner cartridge 68Y is shipped in a state where the portion that faces the through-hole 530 of the filter 540 is covered by the seat member 720, and then is conveyed to a customer.

Here, the toner cartridge 68Y is conveyed to a customer with various postures. Further, during the conveyance of the toner cartridge 68Y, vibration is applied to the toner cartridge 68Y. As a result, the toner may be attached to the filter 540 to get into the inside of the filter 540 and block up the filter 540. Because of this, in this embodiment, as described above, the toner cartridge 68Y is shipped in a state where the seat member 720 faces the filter 540. Through this, the toner is prevented from being attached to the filter 540 and getting into the inside of the filter 540, and the blocking of the filter 540 becomes hard to occur.

On the other hand, in the case where the toner cartridge 68Y is mounted in the image forming apparatus 10 (see FIG. 1) and the toner is supplied from the toner cartridge 68Y, as described above, the first transport member 600 and the second transport member 700 are rotated, and at this time, the toner may be forced for the filter 540 by the seat member 720 of the second transport member 700.

Because of this, in this embodiment, as shown in FIGS. 11 and 12, a circular projection portion 550 is formed on the inner surface of the cover member 500. On the other hand, the projection portion 550, as shown in FIG. 12, is arranged on the outside than the filter 540 to surround the filter 540. Here, if the projection portion 550 is provided as in this embodiment, the seat member 720 of the second transport member 700 is pressed by the projection portion 550, and thus the imposition of the toner for the filter 540 is reduced.

On the other hand, as shown in FIG. 11, it is preferable that the height dimensions H10 of the projection portion 550 (the distance between the vertex portion of the projection portion 550 and the inner surface of the cover member 500) is set to be larger than the thickness H20 of the filter 540. That is, it is preferable that the height dimensions H10 of the projection portion 550 is set to be larger than the distance H20 between the inner surface of the cover member 500 and the second surface 542 of the filter 540. In this case, the imposition of the toner for the filter 540 is reduced.

Further, in this embodiment, the side surface 551 of the outside of the circular projection portion 550 (the side surface 551 positioned on the outer circumferential side rather than the inner circumferential side) is configured to be slanted as shown in FIG. 11. That is, the side surface 551 is formed so that the angle between the side surface 551 and the inner surface of the cover member 500 becomes an obtuse angle, without making the side surface 551 and the inner surface of the cover member 500 orthogonal to each other Here, if the side surface 551 and the inner surface of the cover member 500 are orthogonal to each other, a corner portion is formed in the region where the side surface 551 and the inner surface cross each other, and the toner is liable to be gathered in the corner portion. In this embodiment, if the side surface 551 is slanted, gathering of the toner becomes hard to occur. On the other hand, in this embodiment, it has been described that the side surface 551 of the outside of the projection portion 550 is configured to be slanted. However, the side surface of the inside of the projection portion 550 may be slanted. Even in the case where the side surface of the inside is configured to be slanted, the surface of the inside is formed so that the angle between the side surface of the inside and the inner surface of the cover member 500 becomes an obtuse angle.

On the other hand, in this embodiment, the projection portion 550 is formed in a circular shape. However, even in the case where the projection portion 550 is provided on the upstream side in the rotating direction of the seat member 720 with respect to the filter 540, the imposition of the seat member 720 for the filter 540 is reduced, and thus the toner is prevented from being attached.

Figure 13:
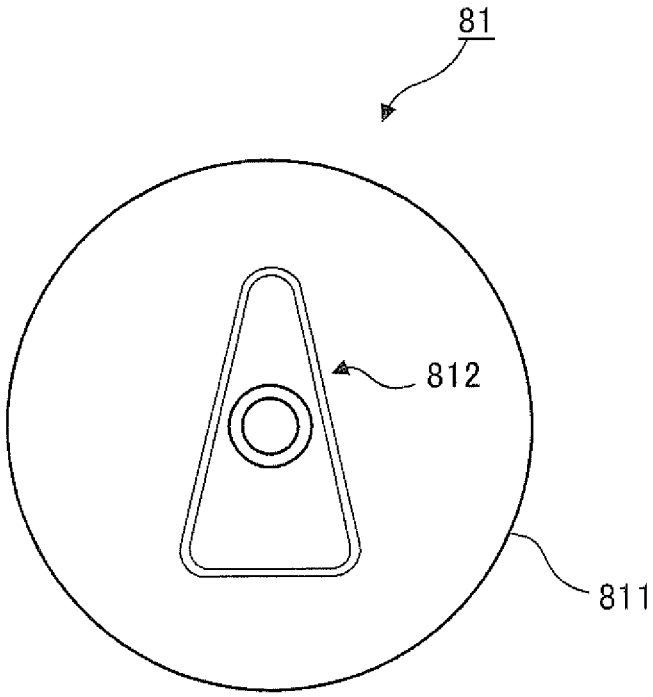
FIG. 13 is a view of a first gear as seen in the direction of an arrow XIII in FIG. 3.

FIG. 13 is a view of a first gear 81 as seen in the direction of an arrow XIII in FIG. 3.

The first gear 81 that functions as a rotating member and a reception member is formed in a disk shape, and as shown in FIG. 13, has a circumferential surface 811. On the other hand, a tooth portion (not illustrated) is provided on the circumferential surface 811, and this tooth portion is tooth-engaged with a tooth portion of a transmission gear 910 (to be described later) provided on the side of the apparatus body 10A to transmit the driving force to the first gear 81. Further, in this embodiment, for the side surface of the first gear 81, as shown in FIG. 13, a mark 812 that is in the form of an isosceles triangle having two long sides and one short side is formed. On the other hand, this mark 812 is formed by a groove formed on the side surface of the first gear 81.

In this embodiment, as described above, during the manufacturing of the toner cartridge 68Y, the first gear 81 is rotated by a manufacturer or a manufacturing device, and the seat member 720 is positioned to face the filter 540. Here, in this embodiment, although the positioning of the seat member 720 is performed as described above, the positioning is performed using the mark 812 at this time. More specifically, the positioning of the seat member 720 is performed by rotating the first gear 81 so that the acute-angled vertex, which is formed on the region where the two long sides cross each other, is directed to the predetermined direction.

In the case of manufacturing the toner cartridge 68Y using the manufacturing device, the seat member 720 is positioned in a predetermined position by reading the mark 812 through a sensor or the like and rotating the first gear 81.

Here, the procedure at the time of manufacturing the toner cartridge 68Y will be described.

In manufacturing the toner cartridge 68Y, the first transport member 600 and the second transport member 700 are first attached to the inside of the toner accommodation portion 400 in a state where the first to third gears 81 to 83 are attached to the toner accommodation portion 400. Then, the cover member 500 is mounted thereon. Thereafter, the first gear 81 is rotated so that the acute-angled vertex is directed to the predetermined direction. Through this, the seat member 720 is arranged to face the filter 540. Next, toner is supplied (charged) to the inside of the toner cartridge 68Y through the opening 510 (see FIG. 2). Thereafter, the opening 510 and the opening 570 are blocked up. Then, the packaging of the toner cartridge 68Y is performed to ship the toner cartridge 68Y.

Here, in this embodiment, the seat member 720 is configured to face the filter 540, and then the toner is supplied to the inside of the toner cartridge 68Y. However, it is also possible to rotate the first gear 81 after supplying the toner to the inside of the toner cartridge 68Y and to make the seat member 720 face the filter 540. However, in the case of supplying the toner to the inside of the toner cartridge 68Y after making the seat member 72 face the filter 540, the pressure of the toner that is applied to the filter 540 in the process of manufacturing the toner cartridge 68Y can be reduced. Further, in this case, the blocking of the filter 540 becomes harder to occur.

Further, if the mark 812 gets out of the predetermined position after the toner cartridge 68Y is manufactured, the first gear 81 is rotated so that the seat member 720 faces the filter 540.

Figure 14:
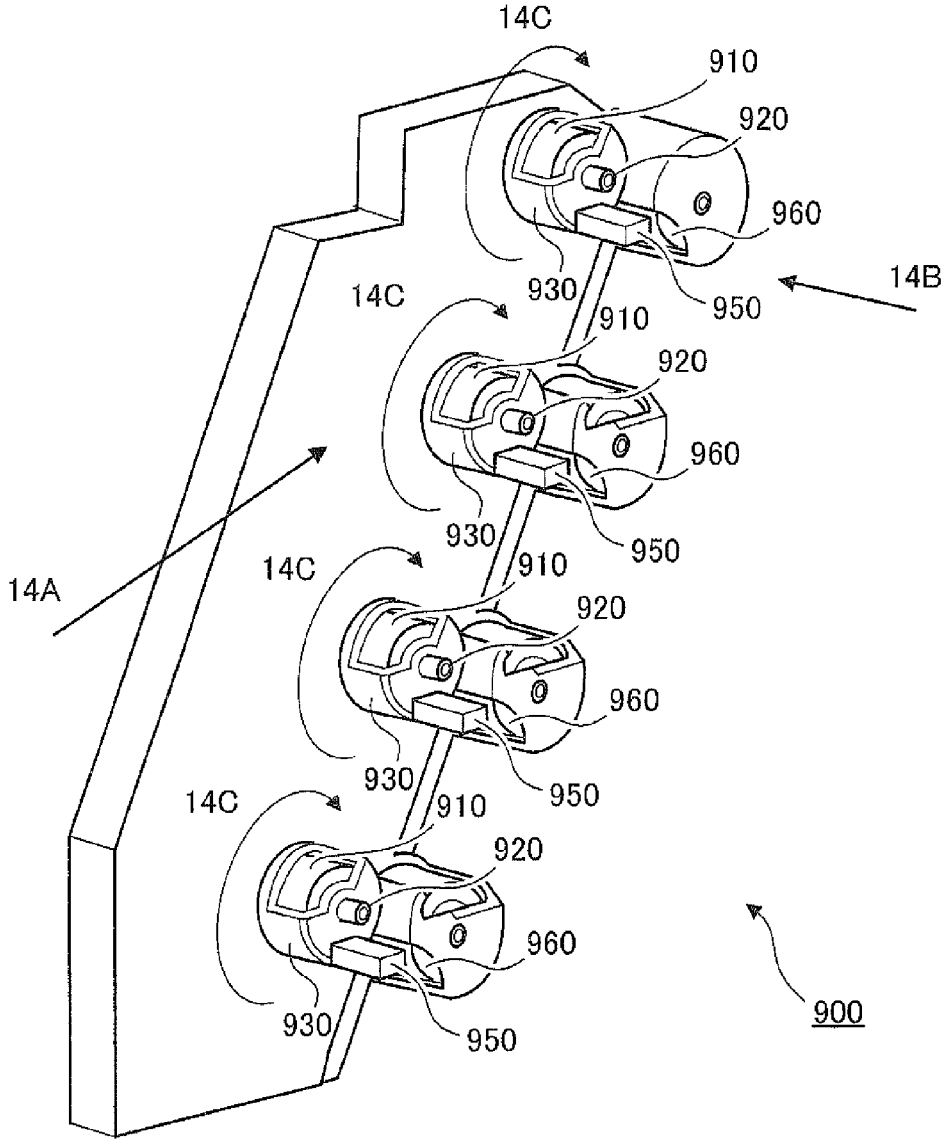
FIG. 14 is a view illustrating a driving force supply unit provided on an apparatus body side.

Then, the configuration of the side of the apparatus body 10A of the image forming apparatus 10 will be described. FIG. 14 is a view illustrating a driving force supply unit provided on the side of the apparatus body 10A.

On the side of the apparatus body 10A of the image forming apparatus 10, as shown in the drawing, a driving force supply unit 900 that supplies driving forces to the first gears 81 of the toner cartridges 68Y, 68M, 68C, and 68K. Here, the driving force supply unit 900 includes a plurality of transmission gears 910 which are rotated by a motor (not illustrated) and transmit the driving forces to the first gears 81 provided in the toner cartridges 68Y, 68M, 68C, and 68K.

Here, when the toner cartridges 68Y, 68M, 68C, and 68K are mounted in the apparatus body 10A, the toner cartridges 68Y, 68M, 68C, and 68K are pressed by a user in the direction indicated by an arrow 14A in the drawing. Further, if the toner cartridges 68Y, 68M, 68C, and 68K reach the predetermined regions, the first gears 81 provided on the side of the toner cartridges 68Y, 68M, 68C, and 68K and the transmission gears 910 provided on the side of the driving force supply unit 900 are engaged with each other. Through this, the driving forces can be transmitted from the side of the driving force supply unit 900 to the side of the toner cartridges 68Y, 68M, 68C, and 68K.

On the other hand, the transmission gears 910 that function as transmission members are formed in a disk shape. In this embodiment, a plurality of support shafts 920, which penetrate the transmission gears 910 to support the transmission gears 910 in a rotatable state, are provided. Here, the support shafts 920 are arranged to go along the direction that is orthogonal to the mounting direction of the toner cartridges 68Y, 68M, 68C, and 68K (direction indicated by an arrow 14A). Further, the support shafts 920 are formed in a cylindrical shape. Further, the support shafts 920 are provided so that front end portions thereof project from the side surfaces of the transmission gears 910. Further, the support shafts 920 are provided not to be rotated but in a fixed state. Further, in this embodiment, covers 930 that cover regions except for the regions that are in contact with the first gear 81 of the transmission gear 910. On the cover 930, flat projections 950 are formed in parallel to the support shafts 920, and the projections 950 are provided on the support shafts 920, respectively.

Figure 15:
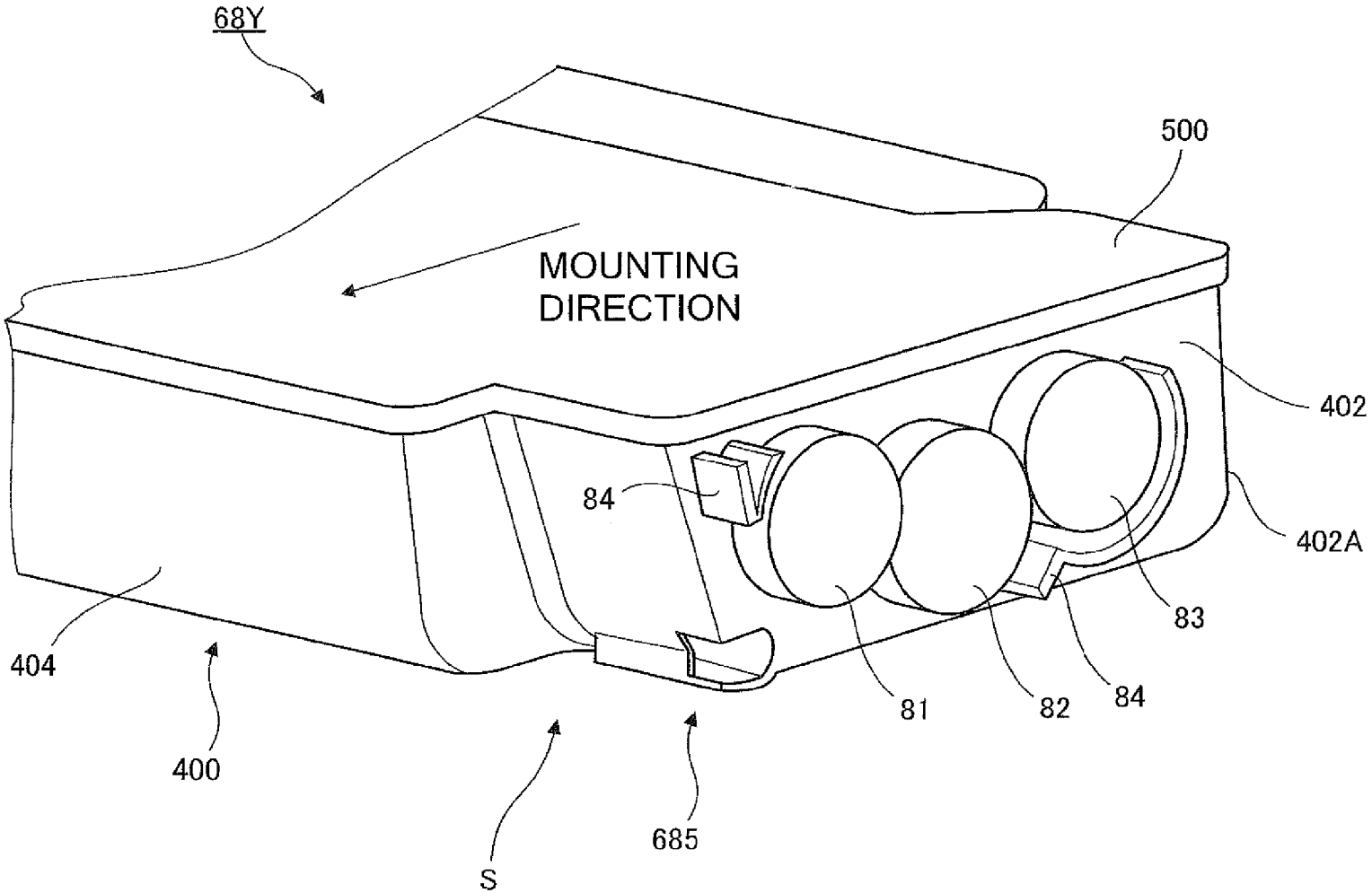
FIG. 15 is a view of a toner cartridge as seen from the downstream side in the mounting direction of the toner cartridge.

FIG. 15 is a view of the toner cartridge 68Y as seen from the downstream side in the mounting direction of the toner cartridge 68Y. In FIG. 15, the whole toner cartridge 68Y is not illustrated, but the second side wall 402 provided with the first to third gears 81 to 83 is illustrated.

Although the description has been omitted as described above, as shown in FIG. 15, a concave portion 685 having a concave shape toward the inside of the toner cartridge 68Y is formed at an end portion on the side of the second side wall 402, which is also an end portion in the longer direction of the fourth side wall 404. More specifically, at a lower end portion of the fourth side wall 404 in the drawing, which is also the fourth side wall 404 of the toner cartridge 68Y, the concave portion 685 having a concave groove shape toward the inside of the toner cartridge 68Y is formed. This concave portion 685 is provided in a space S surrounded by the first region 404A (see FIG. 3) and the second region 404B (see FIG. 3). More specifically, in this embodiment, the concave portion 685 is provided on the lower side than the first gear 81 in the drawing. Further, in this embodiment, the second side wall 402 of the concave portion 685 is opened. The space S may be defined as a space prescribed by an extension surface of the second side wall 402 and an extension surface of the fourth side wall 404.

More specifically, in this embodiment, the concave portion 685 and the toner discharge port 405A are provided on the same side as the side on which the first gear 81 is provided in the toner cartridge 68Y. That is, in this embodiment, the first gear 81 is arranged on one end portion side in the longer direction of the toner cartridge 68Y, and the concave portion 685 and the toner discharge port 405A are also arranged on one end portion side in the longer direction of the toner cartridge 68Y.

Figure 16:
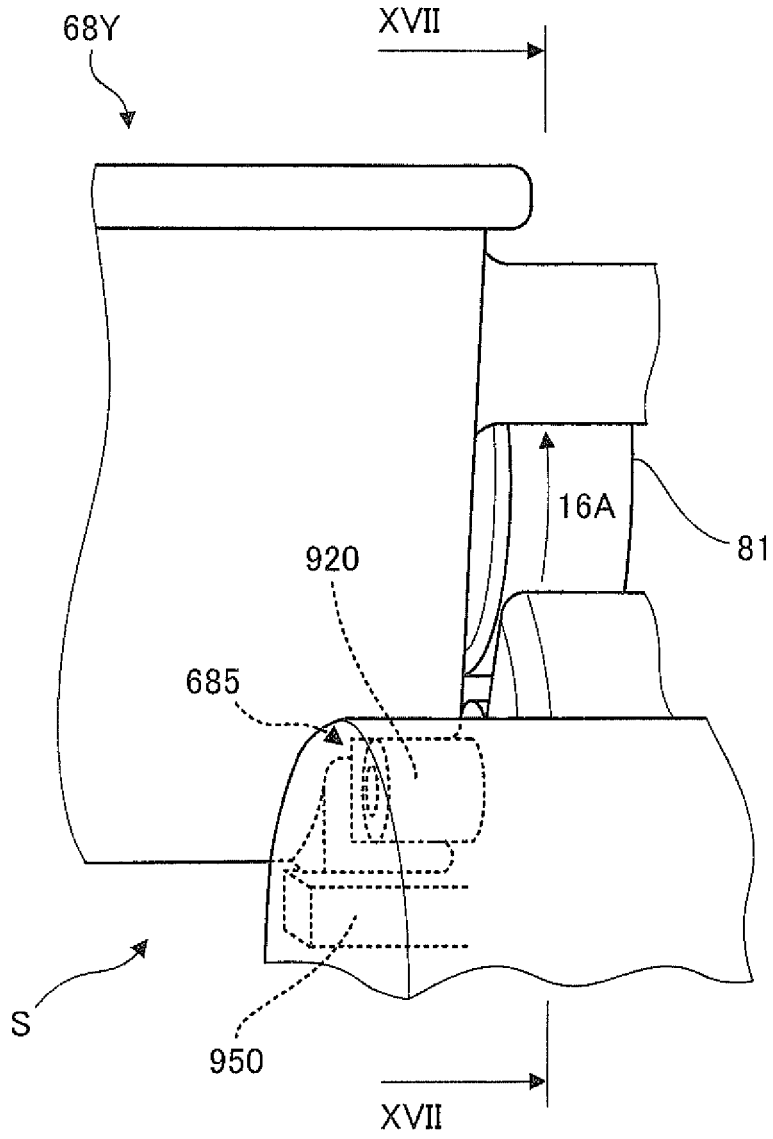
FIG. 16 is a view illustrating the state of a toner cartridge and an apparatus body after the toner cartridge is mounted in the apparatus body.

FIG. 16 is a view illustrating the state of the toner cartridge 68Y and the apparatus body 10A after the toner cartridge 68Y is mounted in the apparatus body 10A. That is, FIG. 16 shows the toner cartridge 68Y and the apparatus body 10A as seen from the direction (downstream side in the mounting direction of the toner cartridge 68Y) indicated by an arrow 14B in FIG. 14.

If the toner cartridge 68Y is mounted in the apparatus body 10A as shown in the drawing, the front end portion of the support shaft 920 gets into the concave portion 685 that functions as a positioning portion. Further, a projection 950 provided on the cover 930 gets into a lower portion of the toner cartridge 68Y. Through this, the positioning of the concave portion 685 is performed by the support shaft 920, and the positioning of the toner cartridge 68Y is performed, so that the movement of the toner cartridge 68Y to the upper side and lower side in the drawing is regulated. Further, if the toner cartridge 68Y is mounted in the apparatus body 10A, a minute gap is provided between the projection 950 and the bottom plate 405, and the projection 950 is positioned almost just below the concave portion 685. On the other hand, in FIG. 16, the projection 950 is concealed by a cover of the gear that is positioned in front of the transmission gear 910 (not illustrated in FIG. 16). Further, in the space S, a relay gear 960 (see FIG. 14) that relays the driving force from a driving source of the apparatus body 10A to the transmission gear 910 is positioned. That is, a part of the relay gear 960 gets into the space S. Through this, the width direction of the apparatus body 10A (the longer direction of the toner cartridge 68Y) becomes smaller.

Through this, the separation of the first gear 81 provided on the side of the toner cartridge 68Y from the transmission gear 910 provided on the side of the apparatus body 10A is restrained, and thus the driving force can be transmitted from the transmission gear 910 to the first gear 81 more accurately. Further, since the separation of the toner cartridge 68Y from the apparatus body 10A is restrained, the separation of the toner discharge port 405A provided on one end portion side in the longer direction of the toner cartridge 68Y from the apparatus body 10A is also restrained, and thus the toner is prevented from leaking from the discharge port. On the other hand, in this embodiment, as shown in FIG. 15, the side of the second side wall 402 of the groove-shaped concave portion 685 is opened, and when the support shaft 920 gets into the concave portion 685, interference between the support shaft 920 and the second side wall 402 does not occur.

Here, in this embodiment, as shown in FIG. 15, the first to third gears 81 to 83 are accommodated in the inside of the circumference 402A of the second side wall 402, and the diameters of the first to third gears 81 to 83 become small. In this case, the length of teeth formed on the circumferential surface of the first gear 81 becomes short, and the first gear 81 and the transmission gear 910 are easily separated from each other in comparison to the case where the teeth are formed with a long length. That is, in comparison to the case where the teeth are formed with a long length, it becomes hard to maintain the engagement between the first gear 81 and the transmission gear 910. Because of this, in this embodiment, as described above, the front end portion of the support shaft 920 gets into the concave portion 685, and this causes the movement of the first gear 81 with respect to the transmission gear 910 to become hard to occur. Further, by accommodating the first to third gears 81 to 83 in the inside of the circumference 402A of the second side wall 402, the first to third gears 81 to 83 are prevented from being damaged. That is, if the first to third gears 81 to 83 project from the cover member 500 or the bottom plate 405, the teeth of the first to third gears 81 to 83 may be broken when the toner cartridge 68Y is put on the bottom or a thing is put on the toner cartridge 68Y.
Further, around the first to third gears 81 to 83, a protection wall 84 that is higher than the first to third gears 81 to 83 is formed. Even if the second side wall 402 is slanted downward and the toner cartridge 68Y is dropped by mistake, the protection wall 84 prevents the damage of the first to third gears 81 to 83. Further, the protection wall 84 formed around the third gear 83 prevents a user from touching the third gear 83 in a state where the toner cartridge 68Y has been mounted.

In this embodiment, the support shaft 920 that supports the transmission gear 910 gets into the concave portion 685 formed in the toner cartridge 68Y. As a comparative example, it may be considered that the front end portion of the support shaft (not illustrated) which supports the first gear 81 provided in the toner cartridge 68Y gets into the concave portion (not illustrated) provided on the side of the apparatus device 10A.

In the case of the configuration in which the front end portion of the support shaft that supports the first gear 81 gets into the concave portion provided on the side of the apparatus body 10A, the support shaft projects from the side surface of the first gear 81. In this case, the projection is present in the portion that is directly touched by a user. Accordingly, as compared with this embodiment, the fear that the projection might be damaged becomes higher, and if the projection is damaged, the driving from the transmission gear 910 to the first gear 81 may not be certainly transmitted. On the other hand, as described above, in the case where the concave portion 685 is formed on the toner cartridge 68Y and the front end portion of the support shaft 920 gets into the concave portion 685, the projection is positioned inside the apparatus device 10A. In this case, the projection is positioned in the region which it is hard for a user's hand to touch.

On the other hand, it has been described that the front end portion of the support portion of the support shaft 920 is put into the concave portion 685. However, the positioning may be performed using a region except for the front end portion of the support shaft 920. For example, the positioning may be performed using the base of the support shaft 920 (region on the base side than the region in which the transmission gear 910 of the support shaft 920 is positioned). That is, the positioning may be performed on the fixed end side rather than the free end side of the support shaft 920. Further, the support shaft may be lengthened and the positioning may be performed in a gap between the front end portion of the support shaft and the region in which the transmission gear 910 is positioned. Further, although the positioning of the toner cartridge 68Y has been described, the positioning can also be performed using the support shaft that supports the transmission member transmitting the driving force even with respect to other members mounted in the image forming apparatus 10.

During the positioning of the first gear 81 with respect to the transmission gear 910, the positioning can be performed through putting of another portion except for the support shaft 920 into the concave portion 685. In this case, however, the number of components interposed between the transmission gear 910 and the first gear 81 becomes larger in comparison to the configuration according to this embodiment. In this case, the accuracy of positioning of the first gear 81 with respect to the transmission gear 910 becomes lowered, and the first gear 910 is easily separated from the transmission gear 910. According to the configuration in this embodiment, since the positioning is performed using the support shaft 920 that directly supports the transmission gear 910, the separation of the first gear 81 from the transmission gear 910 becomes hard to occur.

Further, on the cover 930 that covers the transmission gear 910, a flat projection 950 is formed in parallel to the support shaft 920. If the toner cartridge 68Y is mounted in the apparatus body 10A, the projection 950 is positioned almost just below the concave portion 685. If the support shaft 920 does not function due to the damage thereof, the projection 950 supports the toner cartridge 68Y on the lower side to maintain the positioning of the first gear 81 with respect to the transmission gear 910. Accordingly, as compared with the configuration having no projection 950, the driving force is transmitted from the transmission gear 910 to the first gear 81 more accurately, and it is restrained that the toner leaks from the toner discharge port 405A. On the other hand, a support plate (not illustrated) that supports the toner cartridge 68Y may be provided between the projection 950 and the bottom plate 405 of the toner cartridge 68Y along the longer direction of the toner cartridge 68Y, and the projection 950 may be positioned below the support plate. Even in this case, if the support shaft 920 does not function due to the damage thereof, the projection 950 supports the toner cartridge 68Y on the lower side to maintain the positioning of the first gear 81 with respect to the transmission gear 910.

On the other hand, the transmission gear 910 according to this embodiment is rotated in the direction indicated by an arrow 14C in FIG. 14. As a result, in this embodiment, the first gear 81 that is provided in the toner cartridge 68Y is rotated in the direction as indicated by the arrow 16A in FIG. 16. In this case, the load, which is toward the mounting direction when the toner cartridge 68Y is mounted in the apparatus body 10A, acts on the toner cartridge 68Y. That is, the load that is toward the inner direction of the apparatus body 10A acts on the toner cartridge 68Y. In this case, the separation of the first gear 81 from the transmission gear 910 becomes harder to occur.

Figure 17A:
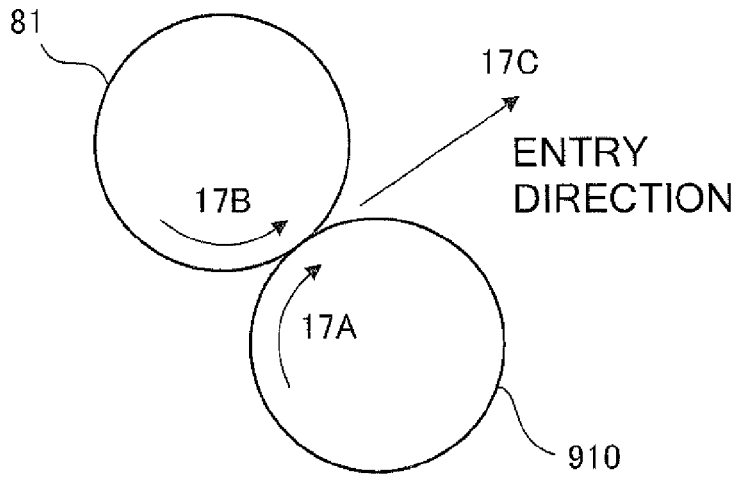
FIGS. 17A and 17B are views of a first gear and a transmission gear in the direction of an arrow XVII in FIG. 16.

FIG. 17 is a view of the first gear 81 and the transmission gear 910 as seen from the direction of an arrow XVII in FIG. 16. As shown in FIG. 17A, in this embodiment, the transmission gear 910 is rotated in the clockwise direction as shown as an arrow 17A in FIG. 17A, and as a result, the first gear 81 provided in the toner cartridge 68Y is rotated in the direction indicated by an arrow 17B in FIG. 17. In this case, when the driving force is transmitted from the transmission gear 910 to the first gear 81, the load that acts in the direction indicated by the arrow 17C in the drawing is applied to the teeth provided on the first gear 81. Through this, the load that is toward the inner direction of the apparatus body 10A acts on the toner cartridge 68Y.

Figure 17B:
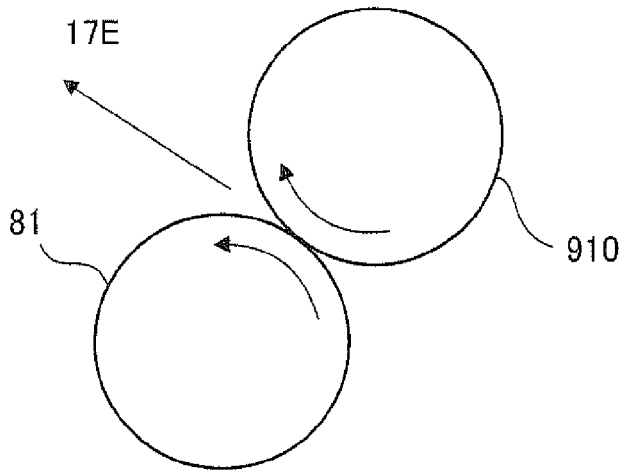

For example, as shown in FIG. 17B, the first gear 81 may be configured to contact the portion that is positioned on the lower side of the transmission gear 910 in the drawing. In this case, the load, which is toward the removing direction (direction indicated by an arrow 17E in the drawing) when the toner cartridge 68Y is removed from the apparatus body 10A, acts on the first gear 81. In this case, the separation of the first gear 81 from the transmission gear 910 is easily performed.

Because of this, in this embodiment, as shown in FIG. 17A, the first gear 81 is configured to contact the portion that is positioned on the upper side of the transmission gear 910 in the drawing, and thus the separation of the first gear 81 from the transmission gear 910 becomes harder to occur. That is, the first gear 81 is configured to contact the portion that is moved in the inner direction of the apparatus body 10A of the transmission gear 910, and thus the separation of the first gear 81 from the transmission gear 910 becomes harder to occur. The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A powder accommodation container mountable on a device main body having a rotary driving member that rotates a rotating member, the powder accommodation container comprising:

an accommodation container body that accommodates powder;

a transport member that is arranged in the accommodation container body, rotates about a rotating shaft, and transports the powder in the accommodation container body; and a discharge port that discharges the powder accommodated in the accommodation container body to the device main body, wherein the discharge port, the rotating member receiving a rotation transferred from the rotary driving member and rotating the transport member, and a concave portion into which a first projection formed on the same axis of the driving member enters are formed on one end side in a longer direction of the accommodation container body, an outer surface of the rotating member contacts an outer surface of the driving member, the concave portion is formed on the accommodation container body, and in a state where the first projection enters into the concave portion, the rotating member receives the rotation transferred from the rotary drive member.

2. The powder accommodation container of claim 1, wherein the first projection is a support axis which rotatably supports the driving member.

3. The powder accommodation container of claim 1, wherein the device main body includes a second projection that is provided below the first projection and is parallel to the first projection, and the powder accommodation container has a portion that enters into a gap between the first projection and the second projection at the one end side.

4. The powder accommodation container of claim 1, wherein the rotating member is attached to one of a plurality of surfaces of the powder accommodation container, and the rotating member is accommodated within an outer periphery of the one surface.

5. The powder accommodation container of claim 1, wherein the rotating member is attached to one of a plurality of surfaces of the powder accommodation container, and a wall portion that is extended in a shaft direction of the rotating member around the rotating member is formed on the one surface and is formed higher in the shaft direction than the rotating member.

6. The powder accommodation container of claim 1, wherein the first projection is a support axis which rotatably supports the driving member.

7. An image forming apparatus comprising:

a powder accommodation container that includes an accommodation container body that accommodates powder, a transport member that is arranged in the accommodation container body, rotates about a rotating shaft, and transports the powder in the accommodation container body; and a discharge port that discharges the powder accommodated in the accommodation container body to a device main body; and the device main body on which the powder accommodation container is mounted and which includes a driving member driving the transport member, wherein the discharge port, a rotating member receiving a rotation transferred from the driving member and rotating the transport member, and a concave portion into which a first projection formed on the same axis of the driving member enters are formed on one end side in a longer direction of the accommodation container body, an outer surface of the rotating member contacts an outer surface of the driving member, the concave portion is formed on the accommodation container body, and in a state where the first projection enters into the concave portion, the rotating member receives the rotation transferred from the rotary drive member.

8. The image forming apparatus of claim 7, wherein the device main body includes a second projection that is provided below the first projection and is parallel to the first projection, and the second projection is located below the powder accommodation container when the powder accommodation container is mounted in the image forming apparatus.

9. The image forming apparatus of claim 7, wherein the rotating member is attached to one of a plurality of surfaces of the powder accommodation container, and the rotating member is accommodated within an outer periphery of the one surface.

10. The image forming apparatus of claim 7, wherein the rotating member is attached to one of a plurality of surfaces of the powder accommodation container, and a wall portion that extends in a shaft direction of the rotating member around the rotating member is formed on the one surface and is formed higher in the shaft direction than the rotating member.

* * * * *